US009457214B2

(12) United States Patent
Goto

(10) Patent No.: US 9,457,214 B2
(45) Date of Patent: Oct. 4, 2016

(54) GAS FIRE-EXTINGUISHING APPARATUS

(75) Inventor: Hideaki Goto, Kobe (JP)

(73) Assignee: AIR WATER SAFETY SERVICE INC., Hyogo (JP)

( * ) Notice: Subject to any disclaimer, the term of this patent is extended or adjusted under 35 U.S.C. 154(b) by 447 days.

(21) Appl. No.: 13/503,441

(22) PCT Filed: Oct. 14, 2010

(86) PCT No.: PCT/JP2010/068087
§ 371 (c)(1),
(2), (4) Date: Apr. 23, 2012

(87) PCT Pub. No.: WO2011/049002
PCT Pub. Date: Apr. 28, 2011

(65) Prior Publication Data

US 2012/0205128 A1 Aug. 16, 2012

(30) Foreign Application Priority Data

| | | |
|---|---|---|
| Oct. 23, 2009 | (JP) | 2009-244986 |
| Feb. 4, 2010 | (JP) | 2010-023575 |
| Apr. 2, 2010 | (JP) | 2010-086586 |
| Jul. 15, 2010 | (JP) | 2010-161096 |

(51) Int. Cl.

| | |
|---|---|
| ***A62C 31/02*** | (2006.01) |
| ***A62C 99/00*** | (2010.01) |
| ***A62C 35/58*** | (2006.01) |

(52) U.S. Cl.
CPC ..... *A62C 99/0018* (2013.01); *A62C 31/02* (2013.01); *A62C 35/58* (2013.01)

(58) Field of Classification Search
CPC ..... F01N 13/00; F01N 13/007; F01N 1/24; F01N 2240/18; F01N 2310/06; A62C 35/58; A62C 31/02; A62C 99/0018
USPC ..... 169/11, 9
See application file for complete search history.

(56) References Cited

U.S. PATENT DOCUMENTS

| | | | |
|---|---|---|---|
| 1,811,762 | A | 6/1931 | Schnell |
| 1,844,104 | A | 2/1932 | Schnell |
| 1,844,105 | A | 2/1932 | Schnell |
| 1,844,106 | A | 2/1932 | Schnell |
| 1,968,456 | A | 7/1934 | Kliefoth |

(Continued)

FOREIGN PATENT DOCUMENTS

| | | |
|---|---|---|
| CN | 2406694 Y | 11/2000 |
| CN | 1441687 | 9/2003 |

(Continued)

OTHER PUBLICATIONS

Kotliar, JP 2003-530922, Oct. 21, 2003.*

(Continued)

*Primary Examiner* — Arthur O Hall
*Assistant Examiner* — Juan C Barrera
(74) *Attorney, Agent, or Firm* — Harness, Dickey & Pierce, P.L.C.

(57) ABSTRACT

A gas fire-extinguishing apparatus according to an embodiment of the invention is configured such that a silencer is disposed on an ejection head which ejects fire-extinguishing gas supplied from a fire-extinguishing gas supply source via a conduit pipe, a diverging pipe and a branch pipe. The configuration suppresses ejection sound caused by an ejection flow of the fire-extinguishing gas.

12 Claims, 15 Drawing Sheets

(56) References Cited

U.S. PATENT DOCUMENTS

| | | | | |
|---|---|---|---|---|
| 2,030,017 | A | 2/1936 | Mille | |
| 2,376,933 | A | 5/1945 | Moran | |
| 2,442,773 | A | 6/1948 | Mason | |
| 2,600,236 | A | 6/1952 | Gibel et al. | |
| 3,339,668 | A | 9/1967 | Trainor et al. | |
| 3,672,465 | A * | 6/1972 | Blatt | F01N 1/082 181/258 |
| 3,949,828 | A | 4/1976 | Frochaux | |
| 3,960,239 | A | 6/1976 | Frochaux et al. | |
| 5,250,094 | A | 10/1993 | Chung et al. | |
| 5,799,652 | A | 9/1998 | Kotliar | |
| 6,148,631 | A | 11/2000 | Watanabe et al. | |
| 6,314,754 | B1 | 11/2001 | Kotliar | |
| 6,334,315 | B1 | 1/2002 | Kotliar | |
| 7,153,446 | B2 * | 12/2006 | Grigg | 252/3 |
| 7,587,969 | B2 * | 9/2009 | Silvers | 89/14.4 |
| 7,753,167 | B2 | 7/2010 | Fukano et al. | |
| 2001/0029750 | A1 | 10/2001 | Kotliar | |
| 2002/0023762 | A1 | 2/2002 | Kotliar | |
| 2005/0126139 | A1 | 6/2005 | Sewell | |
| 2009/0266643 | A1 | 10/2009 | Fukano et al. | |
| 2010/0089689 | A1 | 4/2010 | Cho | |
| 2012/0205128 | A1 | 8/2012 | Goto | |

FOREIGN PATENT DOCUMENTS

| | | | |
|---|---|---|---|
| CN | 101103181 | A | 1/2008 |
| CN | 101366997 | A | 2/2009 |
| DE | 19719535 | A1 | 4/1998 |
| EP | 1151800 | A2 | 11/2001 |
| EP | 1151800 | A2 * | 11/2001 |
| EP | 1837488 | A1 | 9/2007 |
| JP | U 51-005799 | | 1/1976 |
| JP | S53-114511 | A | 10/1978 |
| JP | U 55-12824 | | 3/1980 |
| JP | S5644423 | Y2 | 10/1981 |
| JP | S56-161110 | U | 12/1981 |
| JP | U 58-103100 | | 7/1983 |
| JP | U 59-33450 | | 3/1984 |
| JP | 60-175718 | | 9/1985 |
| JP | 6-017636 | | 1/1994 |
| JP | 6-47683 | | 6/1994 |
| JP | 6-60449 | | 8/1994 |
| JP | H0742849 | B2 | 5/1995 |
| JP | 08-173565 | | 7/1996 |
| JP | 09-124302 | | 5/1997 |
| JP | 09-324617 | | 12/1997 |
| JP | H1030427 | A | 2/1998 |
| JP | 11-090285 | | 4/1999 |
| JP | 11-325655 | | 11/1999 |
| JP | 2003-206718 | | 7/2003 |
| JP | 2003-530922 | | 10/2003 |
| JP | 2004-325870 | A | 11/2004 |
| JP | 2005-002873 | A | 1/2005 |
| JP | 2006-175294 | | 7/2006 |
| JP | WO2006075670 | A1 * | 7/2006 |
| JP | 2006-296491 | A | 11/2006 |
| JP | 2006-307719 | | 11/2006 |
| JP | 2007-167557 | | 7/2007 |
| JP | 2011-255152 | | 12/2011 |
| SU | 1657679 | A1 | 6/1991 |
| WO | WO 2008/108538 | | 9/2008 |

OTHER PUBLICATIONS

Wada, JP 06-017636, Jan. 25, 1994.*
Fukuyoshi, JP 2007-167557, Jul. 5, 2007.*
Kikuchi, JP 09-324617, Dec. 16, 1997.*
Sugano, JP 2006-307719, Nov. 9, 2006.*
Japanese Office Action and English translation thereof dated Jan. 7, 2014.
International Search Report dated Jan. 11, 2011.
International Preliminary Report on Patentability dated May 18, 2012.
Korean Office Action and English translation thereof dated May 30, 2013.
Japanese Office Action and English translation thereof dated Feb. 18, 2014.
Japanese Office Action and English translation thereof dated Feb. 12, 2013.
Japanese Office Action and English translation thereof dated May 10, 2012.
Request for Additional Information and English translation thereof dated Jun. 5, 2012.
Korean Office Action and English translation thereof dated Nov. 15, 2013.
Chinese Office Action and English translation thereof dated Nov. 12, 2013.
Office Action for Japanese Patent Application No. 2014-105467 dated Apr. 7, 2015 with English Statement of Relevance.
Japanese Office Action and English translation thereof dated Mar. 11, 2014.
Korean Office Action and English translation thereof dated Apr. 22, 2014.
Japanese Office Action and Statement of Relevance of Non-English References dated May 20, 2014.
Reconsideration Report and English concise explanation thereof dated Jul. 15, 2014 for corresponding Japanese patent application No. 2012-082679.
Reconsideration Report dated Oct. 7, 2014 for corresponding Japanese patent application No. 2013-210605 and English explanation thereof.
Appeal Decision for corresponding Japanese Patent Application No. 2013-210605 dated Jun. 2, 2015 with English concise explanation thereof.
Appeal Decision for corresponding Japanese Patent Application No. 2012-082679 dated May 7, 2015 with English concise explanation thereof.
Appeal Decision for corresponding Japanese Patent Application No. 2011-267402 dated May 7, 2015 with English concise explanation thereof.
Partial Supplementary European Search Report for European Patent Application No. 10824851.9 dated Apr. 24, 2015.
Extended European Search Report for European Patent Application No. 10824851.9 dated Sep. 9, 2015.
Office Action for Chinese Patent Application No. 201410226960.X issued on Mar. 3, 2016 and English concise explanation thereof.
Office Action for corresponding Japanese Patent Application No. 2015-116171 issued on May 17, 2016 with English concise explanation thereof.
Japanese Office Action and English translation thereof dated Nov. 12, 2013.
Japanese Office Action dated Nov. 12, 2013 with English concise explanation thereof.
Office Action for Japanese Patent Application No. 2015-099483 issued on Feb. 23, 2016 and English concise explanation thereof.
Office Action for corresponding Japanese Patent Application No. 2015-116170 issued on May 24, 2016 with English concise explanation thereof.

* cited by examiner

GAS FIRE-EXTINGUISHING APPARATUS

TECHNICAL FIELD

The present invention relates to a gas fire-extinguishing apparatus which ejects fire-extinguishing gas such as $N_2$ gas or a halide gas as a fire-extinguishing agent into a fire-extinguishing area such as a building, when a fire occurs, so that the fire is extinguished by decreasing an $O_2$ concentration within the fire-extinguishing area and more specifically, to the gas fire-extinguishing apparatus which can be suitably implemented to decrease a large sound occurring when the fire-extinguishing gas is ejected from an ejection head disposed within the fire-extinguishing area.

BACKGROUND ART

In the related art, the gas fire-extinguishing apparatus is provided in various buildings wherein fire-extinguishing gas such as $CO_2$ gas, $N_2$ gas and a halide gas as a fire-extinguishing agent is ejected within a fire-extinguishing area so that the fire is extinguished by decreasing the $O_2$ concentration within the fire-extinguishing area.

FIG. 16 is a perspective view illustrating the fire-extinguishing gas ejection section 1 used in the gas fire-extinguishing apparatus of the related art. The fire-extinguishing gas ejection section 1 includes an ejection head 3 ejecting high-pressure fire-extinguishing gas supplied from a fire-extinguishing gas supply source 2 when a fire occurs and a conduit pipe 4 to which the ejection head 3 is connected.

The conduit pipe 4 has a main pipe 5 connected to the fire-extinguishing gas supply source 2, a diverging pipe 6 interposed in the main pipe 5 and a branch pipe 7 in which the fire-extinguishing gas is guided from the main pipe 5 by the diverging pipe 6 and to which the ejection head 3 is connected. The main pipe 5 is fastened to a base 8 and a bracket 9 fixed to a body of a building or the body thereof by a fastener 10 such as a U-bolt, and disposed in a state where vibration and displacement of the ejection head 3 are suppressed (for example, Patent Literature 1)

CITATION LIST

Patent Literature

Patent Literature 1: Japanese Unexamined Patent Publication JP-A 8-173565 (1996)

SUMMARY OF INVENTION

Technical Problem

In the related art, since the high-pressure fire-extinguishing gas supplied from the fire-extinguishing gas supply source 2 via the conduit pipe 4 is ejected in a large amount from the ejection head, there is a problem in that a large sound like cutting through the air occurs due to the fire-extinguishing gas flow ejected at high speed from a nozzle hole 116 which is formed in a nozzle section 112 of the ejection head 3.

An object of the invention is to provide a gas fire-extinguishing apparatus which can attenuate the sound caused by an ejection flow of fire-extinguishing gas from an ejection head.

Solution to Problem

The invention provides a gas fire-extinguishing apparatus including:

an ejection head having a nozzle section which ejects high-pressure fire-extinguishing gas to a space, a conduit pipe which is connected to the ejection head and guides high-pressure fire-extinguishing gas to the ejection head, a fire-extinguishing gas supply source which supplies the high-pressure fire-extinguishing gas to the conduit pipe, and a silencer which is disposed on the ejection head and attenuates sound caused by ejection of the fire-extinguishing gas from the nozzle section.

According to the invention, high-pressure fire-extinguishing gas supplied from the fire-extinguishing gas supply source to the conduit pipe is ejected to space within the building via the ejection head. The silencer is disposed on the ejection head as described above, and thereby the occurrence of large ejection sound caused by the ejection flow of the fire-extinguishing gas ejected at high speed from the nozzle section of the ejection head can be prevented.

In addition, in the invention, the silencer includes a cylindrical peripheral wall, an end wall formed at one end in an axial direction of the peripheral wall to be perpendicular to an axis of the peripheral wall, and a mounting section detachably formed on the ejection head at the other end in the axial direction of the peripheral wall, and a plurality of vent holes are formed which penetrate the peripheral wall in a thickness direction thereof.

According to the invention, it is preferable that the silencer has a peripheral wall, an end wall and a mounting section, and is detachably mounted to the ejection head by the mounting section. Since the silencer is configured as described above, after the fire-extinguishing gas ejected from the nozzle section of the ejection head impacts on the end wall, the gas is ejected from a plurality of penetrating holes formed in the peripheral wall to the outside and hereby the occurrence of large ejection sound is suppressed.

Furthermore, in the invention, it is preferable that the silencer includes a cylindrical peripheral wall, an end wall formed at one end in an axial direction of the peripheral wall to be perpendicular to the axis of the peripheral wall, and a mounting section detachably formed on the ejection head at the other end in the axial direction of the peripheral wall, and a plurality of vent holes are formed which penetrate the end wall in a thickness direction thereof.

According to the invention, the silencer has a peripheral wall, an end wall and a mounting section, and is detachably mounted to the ejection head by the mounting section. After the fire-extinguishing gas ejected at high speed from the nozzle section of the ejection head impacts on the end wall via the space within the peripheral wall, the gas is ejected from a plurality of penetrating holes formed in an end plate to the outside. According to the silencer configured as described above, the occurrence of large ejection sound when the fire-extinguishing gas is ejected is also prevented.

Furthermore, in the invention, it is preferable that a sound absorption material is accommodated in an inner space defined by the peripheral wall, the end wall and the mounting section.

According to the invention, since the sound absorption material is accommodated in the inner space defined by the peripheral wall, the end wall and the mounting section of the silencer, the vibration of the ejection flow of the fire-extinguishing gas is absorbed by the sound absorption material, whereby the occurrence of ejection sound is further prevented.

Furthermore, in the invention, it is preferable that the silencer includes a cylindrical peripheral wall, an end wall formed at one end in an axial direction of the peripheral wall to be perpendicular to the axis of the peripheral wall, a mounting section integrally formed in the ejection head at the other end in the axial direction of the peripheral wall, and an inner cylinder disposed in a portion of the nozzle section facing a downstream side of a fire-extinguishing gas ejection direction in the nozzle section of the ejection head, a gas ejection hole is formed in the end wall so as to penetrate the end wall in a thickness direction thereof, and the inner cylinder has a cylindrical section in which a plurality of penetrating holes are formed, and an end plate which is formed at one end in the axial direction of the cylindrical section to be perpendicular to the axis of the cylindrical section.

According to the invention, after the fire-extinguishing gas ejected at high speed from the nozzle section of the ejection head impacts on the cylindrical end plate of the inner cylinder within the inner cylinder and is ejected from the plurality of penetrating holes formed in the cylindrical section, and then is ejected from the gas ejection hole formed in the end wall to the outside via the space between the cylindrical body and the peripheral wall. Accordingly, the occurrence of ejection sound is further prevented when ejecting the fire-extinguishing gas.

Furthermore, the invention provides a gas fire-extinguishing apparatus including:

an ejection head having a nozzle section which ejects high-pressure fire-extinguishing gas to a space, a conduit pipe which is connected to the ejection head and guides high-pressure fire-extinguishing gas to the ejection head, and a fire-extinguishing gas supply source which supplies the high-pressure fire-extinguishing gas to the conduit pipe, a nozzle hole which is formed in the nozzle section of the ejection head and has an inner peripheral surface smoothly connected to an inner peripheral surface of the conduit pipe.

According to the invention, the high-pressure fire-extinguishing gas supplied from the fire-extinguishing gas supply source to the conduit pipe is ejected to the space within the building via the ejection head. Since the nozzle hole which has the inner peripheral surface smoothly connected to the inner peripheral surface of the conduit pipe is formed in the ejection head, the occurrence of large ejection sound caused by the ejection flow of the fire-extinguishing gas ejected at high speed from the nozzle section of the ejection head is prevented.

Furthermore, the invention provides a gas fire-extinguishing apparatus including:

an ejection head having a nozzle section which ejects high-pressure fire-extinguishing gas to a space, a conduit pipe which is connected to the ejection head and guides high-pressure fire-extinguishing gas to the ejection head, a fire-extinguishing gas supply source which supplies the high-pressure fire-extinguishing gas to the conduit pipe, and a silencer which is disposed between the ejection head and the conduit pipe and attenuates the sound caused by ejection of the fire-extinguishing gas from the nozzle section.

According to the invention, the high-pressure fire-extinguishing gas supplied from the fire-extinguishing gas supply source to the conduit pipe is ejected to the space within the building via the ejection head. As described above, since the silencer is disposed between the ejection head and the conduit pipe, the occurrence of large ejection sound caused by the ejection flow of the fire-extinguishing gas ejected at high speed from the nozzle section of the ejection head is prevented.

Furthermore, in the invention, it is preferable that the silencer includes a cylindrical peripheral wall, a first mounting section detachably formed on the conduit pipe at one end in an axial direction of the peripheral wall, a second mounting section detachably formed on the ejection head at the other end in the axial direction of the peripheral wall, a first end wall formed at one end in the axial direction of the peripheral wall to be perpendicular to an axis of the peripheral wall, and a second end wall formed at the other end in the axial direction of the peripheral wall to be perpendicular to the axis of the peripheral wall, a penetrating hole is formed so as to penetrate a center section of the first end wall in a thickness direction thereof, a center of which is on the axis of the peripheral wall, and a plurality of penetrating holes are formed so as to penetrate the second end wall in a thickness direction thereof.

According to the invention, the silencer has a peripheral wall, first and the second end walls, first and second mounting sections, and is detachably mounted between the ejection head and the conduit pipe by the first and the second mounting sections. After the fire-extinguishing gas supplied from the conduit pipe and ejected at high speed from the penetrating holes formed in the first end wall impacts on the center section of the second end wall within the silencer, and after is ejected from a plurality of penetrating holes formed in the second end wall within the space defined by the second end wall and the ejection head, the gas is ejected from the ejection head to the outside. The silencer expands the fire-extinguishing gas ejected at high speed from the penetrating holes formed in the first end wall to the space within the silencer, and the flow speed thereof is decreased in the penetrating holes formed in the second end wall so that the occurrence of sound caused by ejection of the fire-extinguishing gas from the ejection head is suppressed.

Furthermore, in the invention, it is preferable that the silencer includes a cylindrical peripheral wall, a first mounting section detachably formed on the conduit pipe at one end in an axial direction of the peripheral wall, a second mounting section detachably formed on the ejection head at the other end in the axial direction of the peripheral wall, a first end wall formed at one end in the axial direction of the peripheral wall to be perpendicular to an axis of the peripheral wall, and a second end wall formed at the other end in the axial direction of the peripheral wall to be perpendicular to the axis of the peripheral wall, a guide section having a plurality of nozzle holes in the first end wall is formed so as to be on the axis of the peripheral wall and face an inner space defined by the peripheral wall, the first end wall and the second end wall, which plurality of nozzle holes eject the high pressure fire-extinguishing gas supplied from the conduit pipe to the inner space, and are formed to be spaced at equal angles in a peripheral direction with respect to the axis of the peripheral wall and are on an axis orthogonal to the axis of the peripheral wall, and a plurality of penetrating holes are formed so as to penetrate the second end wall in a thickness direction thereof.

According to the invention, the silencer has the peripheral wall, the first and the second end walls, the first and the second mounting sections, and is detachably mounted between the ejection head and the conduit pipe by the first and the second mounting sections. After the fire-extinguishing gas supplied from the conduit pipe and ejected at high speed from the nozzle hole of the guide section formed in the first end wall impacts on the inner peripheral surface of the peripheral wall within the silencer, and after is ejected from a plurality of penetrating holes formed in the second end wall within the space defined by the second end wall and the ejection head, the gas is ejected from the ejection head to the outside. Since the silencer expands the fire-extinguishing gas ejected at high speed from the nozzle hole of the guide section formed in the first end wall to the space within the silencer, and the flow speed thereof is decreased in the penetrating holes formed in the second end wall, the occurrence of sound caused by ejection of the fire-extinguishing gas from the ejection head is suppressed.

Furthermore, in the invention, it is preferable that the silencer includes a cylindrical peripheral wall, a first end wall formed at one end in an axial direction of the peripheral wall to be perpendicular to an axis of the peripheral wall, a second end wall having a mounting section which is detachably formed on the ejection head at the other end in the axial direction of the peripheral wall to be perpendicular to the axis of the peripheral wall, a barrier formed between the first end wall and the second end wall to be perpendicular to the axis of the peripheral wall, a cylindrical conduction pipe which guides fire-extinguishing gas ejected from the ejection head to a first silencing chamber which is an inner space defined by the peripheral wall, the first end wall and the barrier, and a cylindrical vent pipe which guides fire-extinguishing gas within a second silencing chamber which is an inner space defined by the peripheral wall, the second end wall and the barrier, a plurality of penetrating holes are formed in the barrier so as to penetrate the barrier in a thickness direction thereof, a connection section which is detachably connected to the ejection head is formed at one end in an axial direction of the conduction pipe, an end plate is formed at the other end in the axial direction of the conduction pipe, and the plurality of penetrating holes are in a portion projected to the first silencing chamber of the peripheral wall of the conduction pipe so as to penetrate the peripheral wall of the conduction pipe in a thickness direction thereof, and the vent pipe is disposed to penetrate the barrier and the first end wall.

According to the invention, the silencer includes the peripheral wall, the first barrier, the second end wall having the mounting section, and the barrier, and is detachably mounted on the ejection head by the mounting section. The fire-extinguishing gas, ejected at high speed in the first silencing chamber from a plurality of penetrating holes formed in the conduction pipe which is connected to the ejection head by the connection section is ejected from the plurality of penetrating holes formed in the barrier to the second silencing chamber. The fire-extinguishing gas ejected to the second silencing chamber is ejected to the outside of the silencer via the vent pipe. The silencer expands the fire-extinguishing gas ejected at high speed from the plurality of penetrating holes formed in the conduction pipe to the space within the first silencing chamber and to the space within the second silencing chamber and the flow speed in the vent pipe is decreased so that the occurrence of sound caused by ejection of the fire-extinguishing gas from the vent pipe is suppressed.

Furthermore, in the invention, it is preferable that the silencer includes a cylindrical peripheral wall, a first end wall formed at one end in an axial direction of the peripheral wall to be perpendicular to an axis of the peripheral wall, a second end wall having a mounting section which is detachably formed on the ejection head at the other end in the axial direction of the peripheral wall to be perpendicular to the axis of the peripheral wall, a barrier formed between the first end wall and the second end wall to be perpendicular to the axis of the peripheral wall, a cylindrical conduction pipe which guides fire-extinguishing gas ejected from the ejection head to a first silencing chamber which is an inner space defined by the peripheral wall, the first end wall and the barrier, and a plurality of cylindrical vent pipes which guide the fire-extinguishing gas within a second silencing chamber which is an inner space defined by the peripheral wall, the second end wall and the barrier to an outside, a plurality of penetrating holes are formed so as to penetrate the barrier in a thickness direction thereof, a connection section which is detachably connected to the ejection head is formed at one end in an axial direction of the conduction pipe, an end plate is formed at the other end in the axial direction of the conduction pipe, and the plurality of penetrating holes are in a portion projected to the first silencing chamber of the peripheral wall of the conduction pipe so as to penetrate the peripheral wall of the conduction pipe in a thickness direction thereof, and the plurality of vent pipes are disposed to be spaced at equal angles in a peripheral direction with respect to the axis of the peripheral wall and are on an axis orthogonal to the axis of the peripheral wall and are formed so as to penetrate each peripheral wall.

According to the invention, the silencer includes a peripheral wall, a first barrier, a second end wall having the mounting section, and a barrier, and is detachably mounted on the ejection head by the mounting section. The fire-extinguishing gas ejected at high speed in the first silencing chamber from a plurality of penetrating holes formed in the conduction pipe which is connected to the ejection head by the connection section is ejected from the plurality of penetrating holes formed in the barrier to the second silencing chamber. The fire-extinguishing gas ejected to the second silencing chamber is ejected to the outside of the silencer via the vent pipe. The silencer expands the fire-extinguishing gas ejected at high speed from the plurality of penetrating holes formed in the conduction pipe to the space within the first silencing chamber and to the space within the second silencing chamber and the flow speed in the vent pipe is decreased, so that the occurrence of sound caused by ejection of the fire-extinguishing gas from the vent pipe is suppressed.

Furthermore, in the invention, it is preferable that the silencer includes a cylindrical peripheral wall, an end wall formed at one end in an axial direction of the peripheral wall to be perpendicular to an axis of the peripheral wall, a mounting section detachably formed on the ejection head, and a sound absorption material which is accommodated in an inner space defined by the peripheral wall, the end wall and the ejection head, and made of a porous metal.

According to the invention, the sound absorption material is made of the porous metal and accommodated in the inner space. The sound absorption material as described above, is disposed immediately after the nozzle hole so that the fire-extinguishing gas supplied from the branch pipe is gradually expanded with the decreased pressure and the flow speed thereof can be decreased. Accordingly, the occurrence of ejection sound caused by the ejection of the fire-extinguishing gas can be suppressed.

Furthermore, in the invention, it is preferable that in the silencer, the sound absorption material includes a first sound absorption material disposed at one end in the axial direction of the peripheral wall and a second sound absorption material disposed at the other end in the axial direction of the peripheral wall.

According to the invention, since the sound absorption material includes the first sound absorption material disposed at one end in the axial direction of the peripheral wall and the second sound absorption material disposed at the other end in the axial direction of the peripheral wall, the fire-extinguishing gas supplied from the branch pipe is gradually expanded with the decreased pressure by the first sound absorption material immediately after the nozzle hole and the flow speed thereof can be decreased. In addition, the fire-extinguishing gas is further expanded with the decreased pressure by the second sound absorption material immediately before the ejection and the flow speed thereof can be decreased. Accordingly, the occurrence of ejection sound caused by the ejection of the fire-extinguishing gas can be suppressed.

Furthermore, in the invention, it is preferable that the silencer further includes a third sound absorption material disposed between the first sound absorption material and the second sound absorption material.

According to the invention, since the third sound absorption material disposed between the first sound absorption material and the second sound absorption material, the sound vibration caused by the ejection flow of the fire-extinguishing gas is absorbed by the third sound absorption material and the occurrence of ejection sound caused by the ejection of the fire-extinguishing gas can be suppressed.

Advantageous Effects of Invention

According to the invention, since the silencer is disposed on the ejection head, the occurrence of large ejection sound can be prevented even though the fire-extinguishing gas is ejected from the nozzle section of the ejection head when the fire occurs.

In addition, according to the invention, since the nozzle hole having the inner peripheral surface smoothly connecting the inner peripheral surface of the conduit pipe is formed in the ejection head, the occurrence of large ejection sound can be prevented even though the fire-extinguishing gas is ejected from the nozzle section of the ejection nozzle when the fire occurs.

In addition, according to the invention, since the silencer is disposed between the ejection head and the conduit pipe, the occurrence of large ejection sound can be prevented even though the fire-extinguishing gas is ejected from the nozzle section of the ejection nozzle when the fire occurs.

BRIEF DESCRIPTION OF DRAWINGS

Other and further objects, features, and advantages of the invention will be more explicit from the following detailed description taken with reference to the drawings wherein.

DESCRIPTION OF EMBODIMENTS

Figure 1:
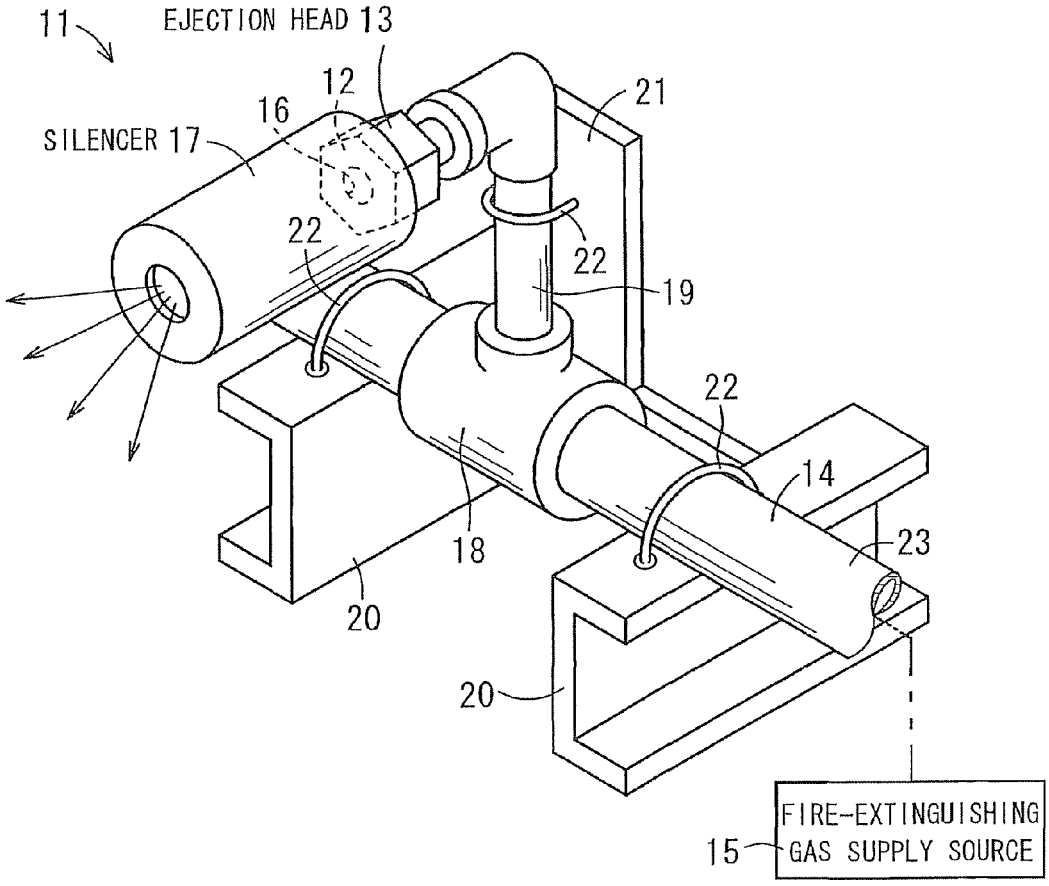
FIG. 1 is a perspective view illustrating a fire-extinguishing gas ejection section 11 included in a gas fire-extinguishing apparatus according to an embodiment of the invention.

Now referring to the drawings, preferred embodiments of the invention are described below.

FIG. 1 is a perspective view illustrating a fire-extinguishing gas ejection section 11 included in a gas fire-extinguishing apparatus according to an embodiment of the invention. The gas fire-extinguishing apparatus of the embodiment is disposed within a fire-extinguishing area of a building and includes an ejection head 13 having a nozzle section 12 ejecting high-pressure fire-extinguishing gas into a space within the fire-extinguishing area, a conduit pipe 14, to which the ejection head 13 is connected, and guides high-pressure fire-extinguishing gas to the ejection head 13, a fire-extinguishing gas supply source 15 supplying high-pressure inert gas to the conduit pipe 14, and a silencer 17 which is disposed on the ejection head 13 and attenuates sound generated due to ejection sound or the like by the ejection of the fire-extinguishing gas ejected from a nozzle hole 16 which is formed in the nozzle section 12.

The fire-extinguishing gas is realized by an inert gas such as an N2 gas, or a CO2 gas, and an active gas such as a halide gas and such fire-extinguishing gas is ejected as a fire-extinguishing agent so that O2 concentration within the fire-extinguishing area is decreased and thereby the fire can be extinguished.

The fire-extinguishing gas ejection section 11 is constituted by the ejection head 13 and the silencer 17. In the fire-extinguishing gas ejection section 11, the fire-extinguishing gas is supplied from the fire-extinguishing gas supply source 15 to the ejection head 13 via conduit pipe 14. The conduit pipe 14 includes a main pipe 23 connected to the fire-extinguishing gas supply source 15, a diverging pipe 18 interposed in the main pipe 23 and a branch pipe 19 connected to the diverging pipe 18, and the high-pressure fire-extinguishing gas is guided from the fire-extinguishing gas supply source 15 to the ejection head 13 via the conduit pipe 14. The conduit pipe 14 is fastened to a base 20 and a bracket 21 by a fastener 22 such as a U-bolt, and is disposed on a body of a building in a state where vibration and displacement thereof are suppressed.

Figure 2:
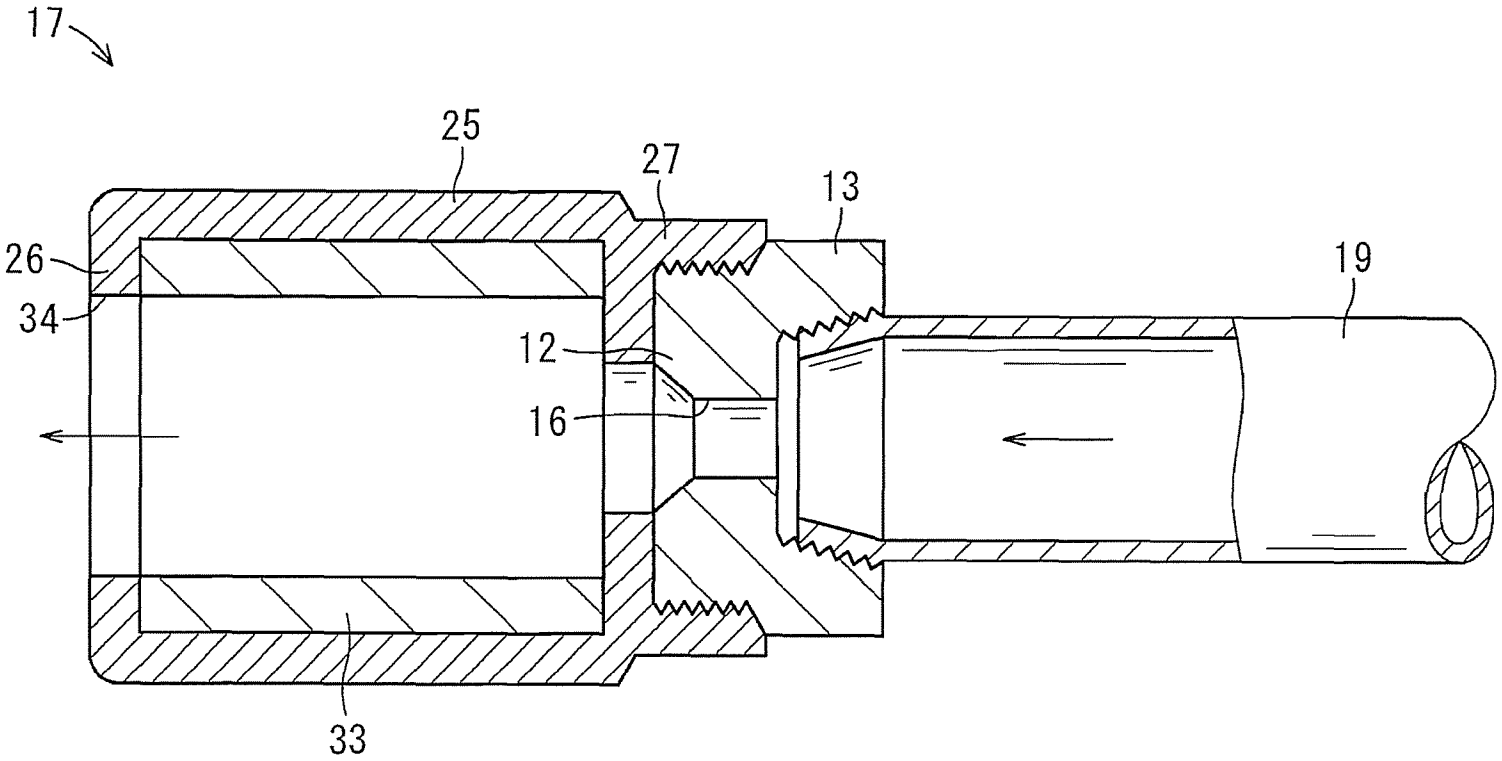
FIG. 2 is an enlarged cross-sectional view of a silencer 17.

FIG. 2 is an enlarged cross-sectional view of the silencer 17. The silencer 17 includes a cylindrical peripheral wall 25, an end wall 26 which is formed at one end in an axial direction of the peripheral wall 25 to be perpendicular to the axis of the peripheral wall 25, a mounting section 27 detachably connected to the ejection head 13 at the other end in the axial direction of the peripheral wall 25, and a cylindrical sound absorption material 33 accommodated and mounted along an inner peripheral surface of the inside of the peripheral wall 25. Such a sound absorption material 33 may be configured by, for example, a laminate of two or more wire meshes. A gas ejection hole 34 is formed in the end wall 26 in the same axial direction.

Since the silencer 17 configured as described above, is used, the sound vibration caused by the ejection flow of the fire-extinguishing gas ejected in high speed from the nozzle section 12 of the ejection head 13 is absorbed by the sound absorption material 33, and the fire-extinguishing gas is ejected from the gas ejection hole 34 to the outside. Accordingly, the occurrence of ejection sound caused by the ejection of the fire-extinguishing gas can be suppressed.

Figure 3:
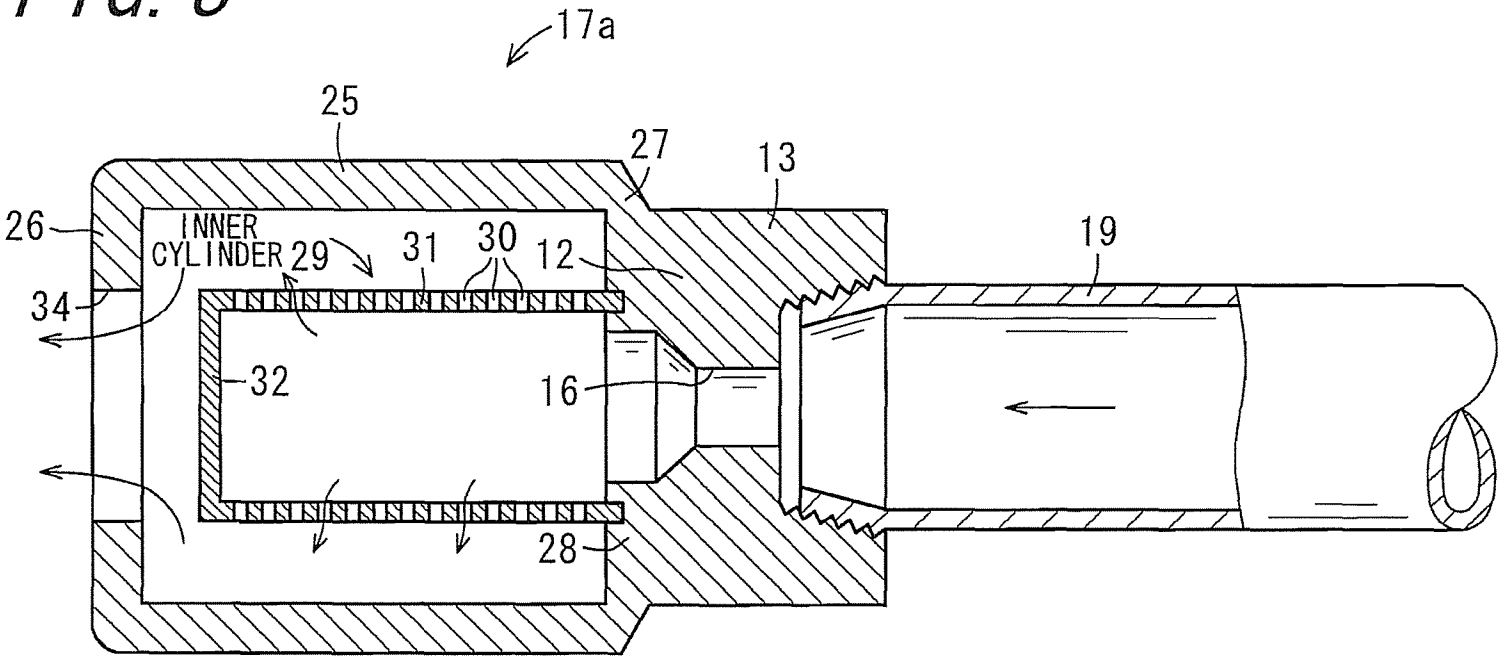
FIG. 3 is an enlarged cross-sectional view illustrating a silencer 17*a* included in a gas fire-extinguishing apparatus according to another embodiment of the invention.

FIG. 3 is an enlarged cross-sectional view illustrating a silencer 17*a* included in a gas fire-extinguishing apparatus according to another embodiment of the invention. In addition, portions corresponding to the above-described embodiment are denoted by the same reference numerals. The silencer 17*a* of the embodiment includes a cylindrical peripheral wall 25, the end wall 26 which is formed at one end in the axial direction of the peripheral wall 25 to be perpendicular to the axis of the peripheral wall 25, the mounting section 27 in which the ejection head 13 is integrally formed at the other end in the axial direction of the peripheral wall 25, and an inner cylinder 29 which is disposed in a portion 28 of the nozzle section 12 facing a downstream side in a fire-extinguishing gas ejection direction in the nozzle section 12 of the ejection head 13.

The inner cylinder 29 has a right cylinder section 31 in which a plurality of penetrating holes 30 are formed, and an end plate 32 formed at one end in the axial direction of the cylinder section 31 to be perpendicular to the axial direction of the cylinder section 31.

According to the above-described silencer 17*a*, within the inner cylinder 29, the fire-extinguishing gas ejected at high speed from the nozzle section of the ejection head 13 impacts on the cylindrical end plate 32 of the inner cylinder 29, and is ejected from a plurality of penetrating holes 30 formed on the cylinder section 31, and then the fire-extinguishing gas is ejected to the outside from the gas ejection hole 34 formed in the end wall 26 via a space between the cylinder section 31 and the peripheral wall 25, and the occurrence of sound caused by ejection of the fire-extinguishing gas is suppressed.

Figure 4:
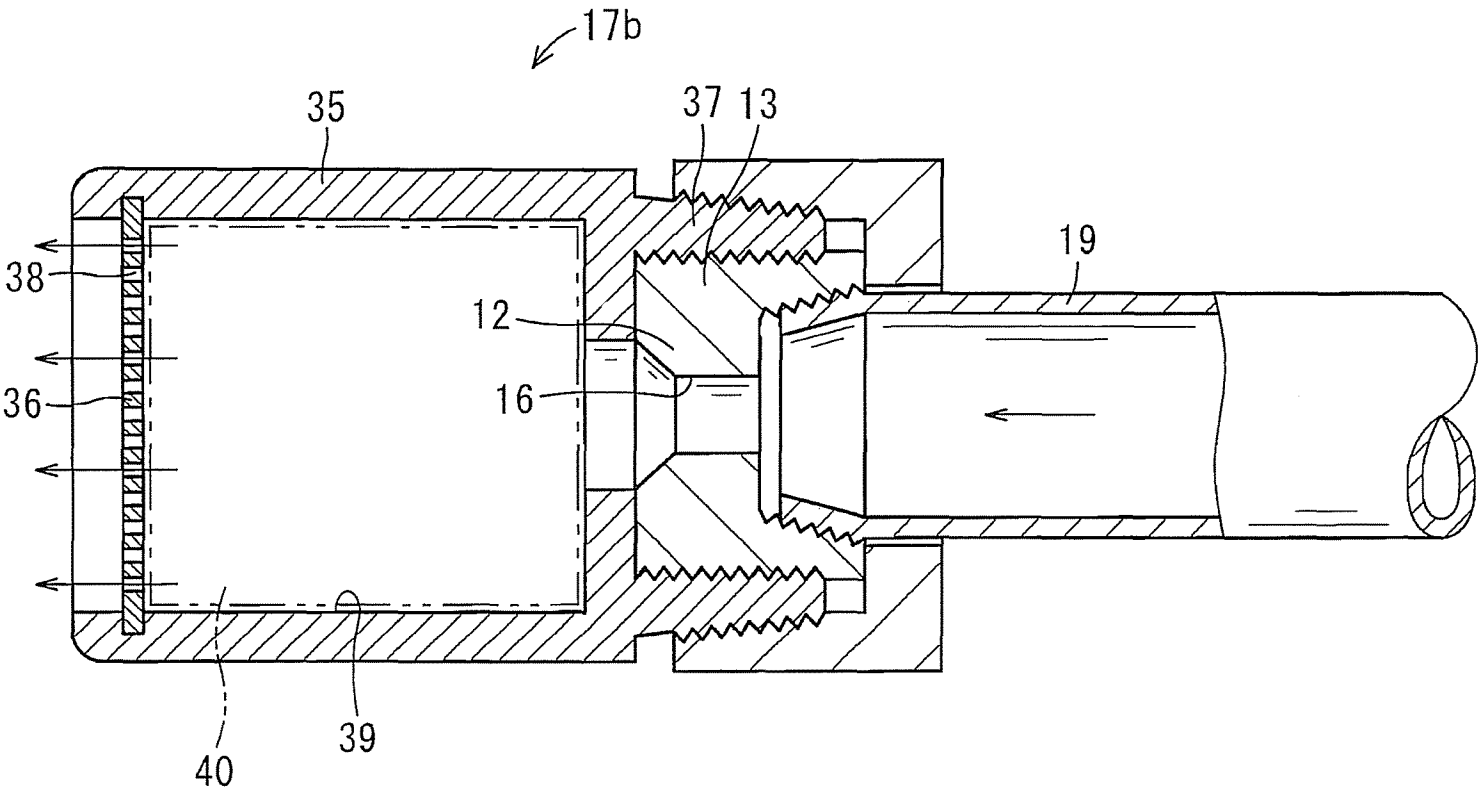
FIG. 4 is an enlarged cross-sectional view illustrating a silencer 17*b* included in a gas fire-extinguishing apparatus according to yet another embodiment of the invention.

FIG. 4 is an enlarged cross-sectional view illustrating a silencer 17*b* included in a gas fire-extinguishing apparatus according to yet another embodiment of the invention. The silencer 17*b* of the embodiment includes a cylindrical peripheral wall 35, an end wall 36 which is formed at one end in the axial direction of the peripheral wall 35 to be perpendicular to the axis of the peripheral wall 35, and a mounting section 37 detachably formed on the ejection head 13 at the other end in the axial direction of the peripheral wall 35. A plurality of vent holes 38 are formed in the end wall 36 so as to penetrate the end wall 36 in a thickness direction thereof.

In addition, the silencer 17*b* accommodates a sound absorption material 40 in an inner space 39 defined by the peripheral wall 35, the end wall 36 and the mounting section 37. The sound absorption material 40 may be configured by a laminate of the two or more wire meshes.

According to the gas fire-extinguishing apparatus including the silencer 17*b* configured as described above, the fire-extinguishing gas ejected at high speed from the nozzle section 12 of the ejection head 13 impacts on the end wall 36 via a space within the peripheral wall 35 and is ejected from the plurality of vent holes 38 formed in the end wall 36 to the outside. The occurrence of large sound can also be prevented from occurring by the above-described configuration of the silencer.

Figure 5:
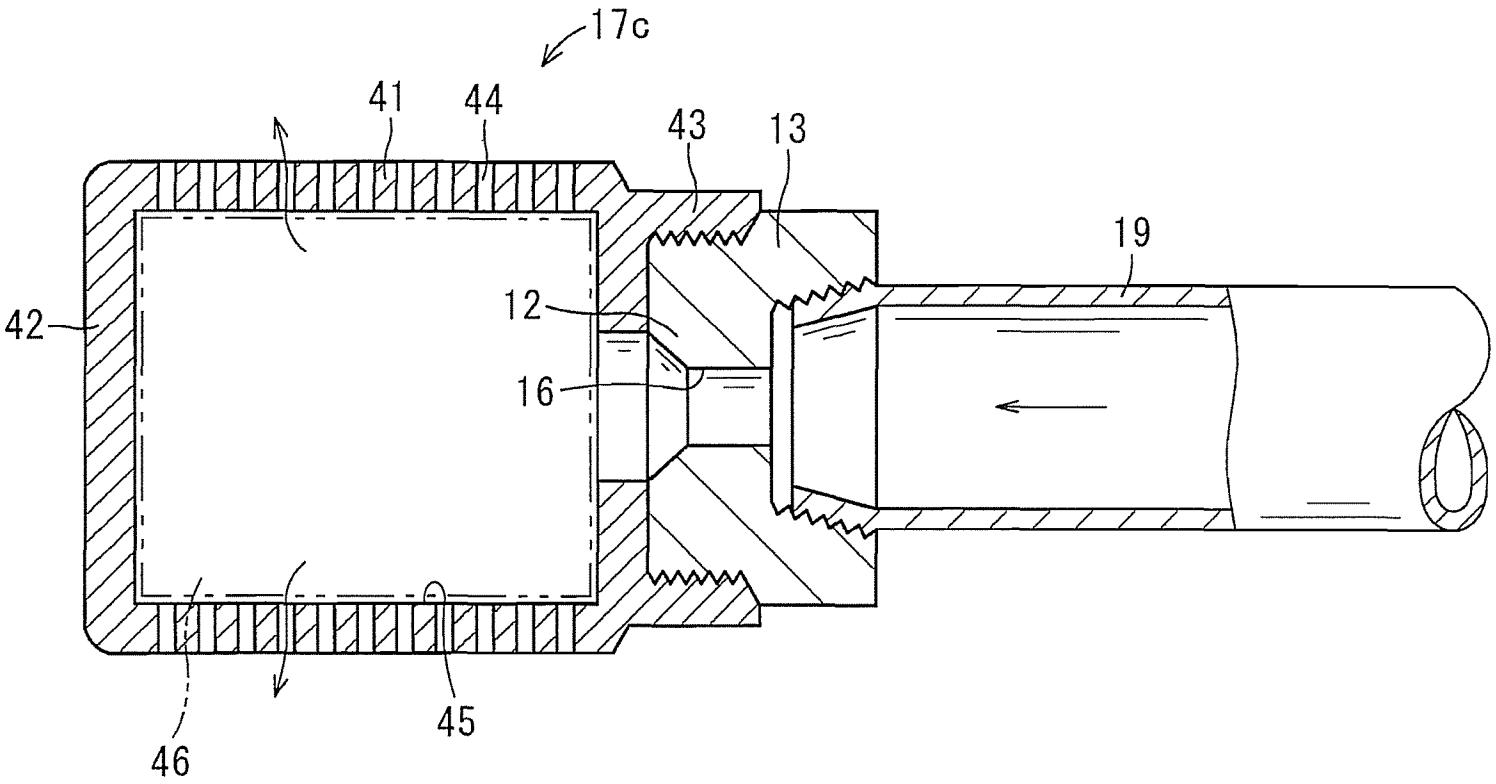
FIG. 5 is an enlarged cross-sectional view illustrating a silencer 17*c* included in a gas fire-extinguishing apparatus according to yet another embodiment of the invention.

FIG. 5 is an enlarged cross-sectional view illustrating a silencer 17*c* included in a gas fire-extinguishing apparatus according to yet another embodiment of the invention. In addition, portions corresponding to the above-described embodiment are denoted by the same reference numerals. The silencer 17 of the embodiment includes a cylindrical peripheral wall 41, an end wall 42 which is formed at one end in the axial direction of the peripheral wall 41 to be perpendicular to the axis of the peripheral wall 41, and a mounting section 43 detachably formed on the ejection head 13 at the other end in the axial direction of the peripheral wall 41. A plurality of vent holes 44 are formed in the peripheral wall 41 so as to penetrate the peripheral wall 41 in a thickness direction thereof.

The silencer 17*c* configured as described above accommodates a sound absorption material 46 in an inner space 45 defined by the peripheral wall 41, the end wall 42 and the mounting section 43. The sound absorption material 46 may be configured by, for example, a laminate of two or more wire meshes.

According to the gas fire-extinguishing apparatus including the above-described silencer 17*c*, the fire-extinguishing gas ejected from the nozzle section 12 of the ejection head 13 impacts on the end wall 42 the flow speed thereof is attenuated, and the fire-extinguishing gas is ejected from a plurality of vent holes 44 formed in the peripheral wall 41 to the outside. Accordingly, the occurrence of large sound caused by the ejection of the fire-extinguishing gas can be prevented.

Figure 6:
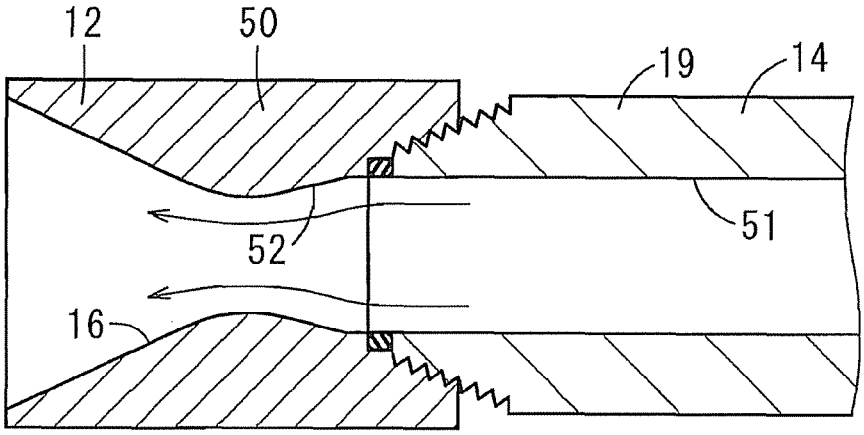
FIG. 6 is a cross-sectional view illustrating an ejection head 50 of a gas fire-extinguishing apparatus according to yet another embodiment of the invention.
Figure 7:
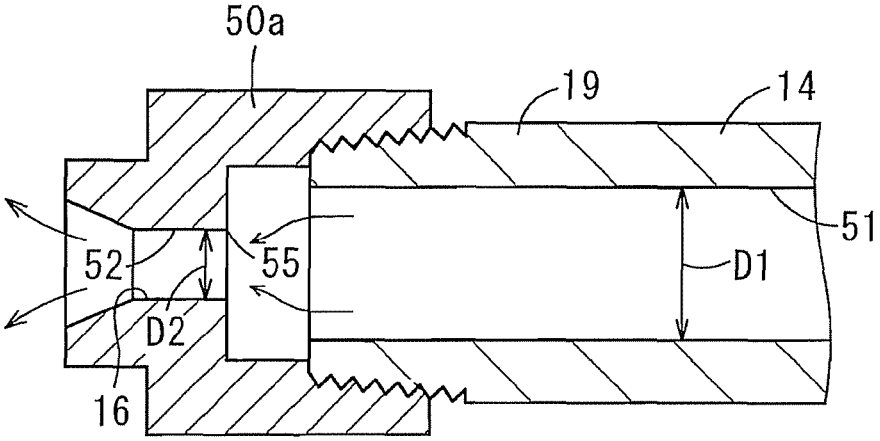
FIG. 7 is a cross-sectional view explaining an effect of the ejection head 50 shown in FIG. 6.

FIG. 6 is a cross-sectional view illustrating an ejection head 50 of a gas fire-extinguishing apparatus according to yet another embodiment of the invention, and FIG. 7 is a cross-sectional view explaining an effect of the ejection head 50 shown in FIG. 6. In addition, portions corresponding to the above-described embodiment are denoted by the same reference numerals. The gas fire-extinguishing apparatus of the embodiment is disposed within a building and includes the ejection head 50 having the nozzle section 12 ejecting high-pressure fire-extinguishing gas into the space within the building, the conduit pipe 14, to which the ejection head 50 is connected and which guides high-pressure fire-extinguishing gas to the ejection head, the fire-extinguishing gas supply source 15 which supplies high-pressure fire-extinguishing gas to the conduit pipe 14.

The nozzle hole 16 is formed in the nozzle section 12 of the ejection head 50, and the nozzle hole 16 has an inner peripheral surface 52 smoothly connected to an inner peripheral surface 51 of the branch pipe 19 of the conduit pipe 14.

By using the ejection head 50 configured as described above, the high-pressure fire-extinguishing gas supplied from the fire-extinguishing gas supply source 15 to the conduit pipe 14 is ejected to the space within the building via the nozzle hole 16 of the ejection head 50. At this time, since the nozzle hole 16 which has the ejection head 50 smoothly connected to the inner peripheral surface 51 of the branch pipe 19 of the conduit pipe 14, is formed in the ejection head 50, the occurrence of large ejection sound can be prevented, wherein the sound is caused by the ejection flow of the fire-extinguishing gas ejected at high speed from the nozzle section 12 of the ejection head 50, for example, in an edge section 55 or the like facing the flow-in port of the nozzle hole 16 having an inner diameter D2 smaller than the inner diameter D1 of the branch pipe 19 of the conduit pipe 14 in an ejection head 50*a* shown in FIG. 7.

Figure 8:
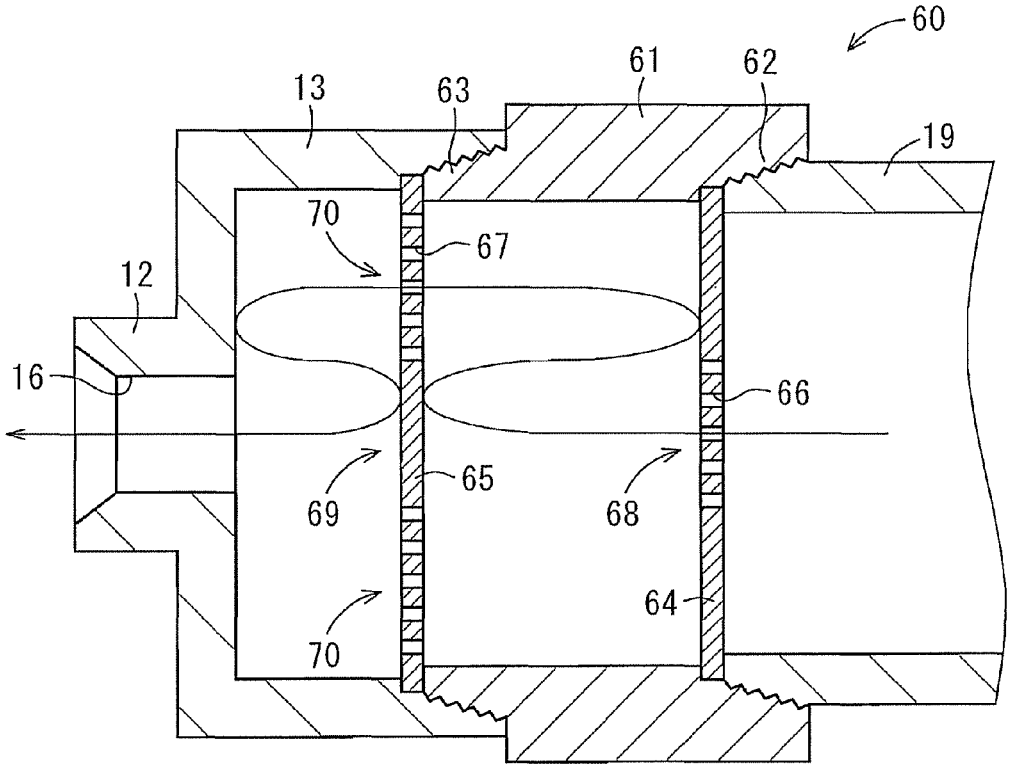
FIG. 8 is an enlarged cross-sectional view illustrating a silencer 60 included in a gas fire-extinguishing apparatus according to yet another embodiment of the invention.

FIG. 8 is an enlarged cross-sectional view illustrating a silencer 60 included in a gas fire-extinguishing apparatus according to yet another embodiment of the invention. In addition, portions corresponding to the above-described embodiment are denoted by the same reference numerals. The silencer 60 of the embodiment has a cylindrical peripheral wall 61, a mounting section 62 which is detachably formed on the branch pipe 19 at one end in the axial direction of the peripheral wall 61, a mounting section 63 detachably formed on the ejection head 13 at the other end in the axial direction of the peripheral wall 61, an end wall 64 formed at one end in the axial direction of the peripheral wall 61 to be perpendicular to the axis of the peripheral wall 61, and an end wall 65 formed at the other end in the axial direction of the peripheral wall 61 to be perpendicular to the axis of the peripheral wall 61.

At least one of the penetrating holes 66 is formed in the end wall 64 so as to penetrate the end wall 64 in a thickness direction thereof. The at least one of the penetrating holes 66 is formed in a center section 68 of the end wall 64, the center of which is on the axis of the peripheral wall 61 and the flow of the fire-extinguishing gas supplied from the branch pipe 19 is throttled. A plurality of penetrating holes 67 are formed in the end wall 65 so as to penetrate the end wall 65 in a thickness direction thereof. The plurality of penetrating holes 67 are formed in a peripheral section 70 remain except a center section 69 of the end wall 65 and the center of which is on the axis of the peripheral wall 61. The end walls 64 and 65 are made of, for example, the punching metal.

According to the silencer 60 as described above, the fire-extinguishing gas ejected at high speed from the penetrating holes 66 formed in the end wall 64 impacts on the center section 69 of the end wall 65 within the silencer 60, the flow speed thereof is attenuated and the gas is ejected from the plurality of penetrating holes 67 formed in the end wall 65 within the space defined by the end wall 65 and the ejection head 13, and then the gas is ejected from the nozzle hole 16 formed in the nozzle section 12 to the outside. Since the silencer 60 expands the fire-extinguishing gas ejected at high speed from the penetrating holes 66 formed in the end wall 64 into the space within the silencer 60, the flow speed thereof is decreased in the penetrating holes 67 formed in the end wall 65 and thereby the occurrence of sound caused by ejection of the fire-extinguishing gas from the nozzle hole 16 can be suppressed.

In the embodiment shown in FIG. 8, the penetrating holes 67 are not formed in the center section 69 of the end wall 65, however, the penetrating holes 67 may be formed in the center section 69 of the end wall 65. The amount of the fire-extinguishing gas ejected at high speed rebounding from the penetrating holes 66 is larger and the flow speed is more decreased in a case where the penetrating holes 67 are not formed in the center section 69 of the end wall 65 than those in a case where the penetrating holes 67 are formed in the center section 69 of the end wall 65 so that the silencing effect is high.

Figure 9:
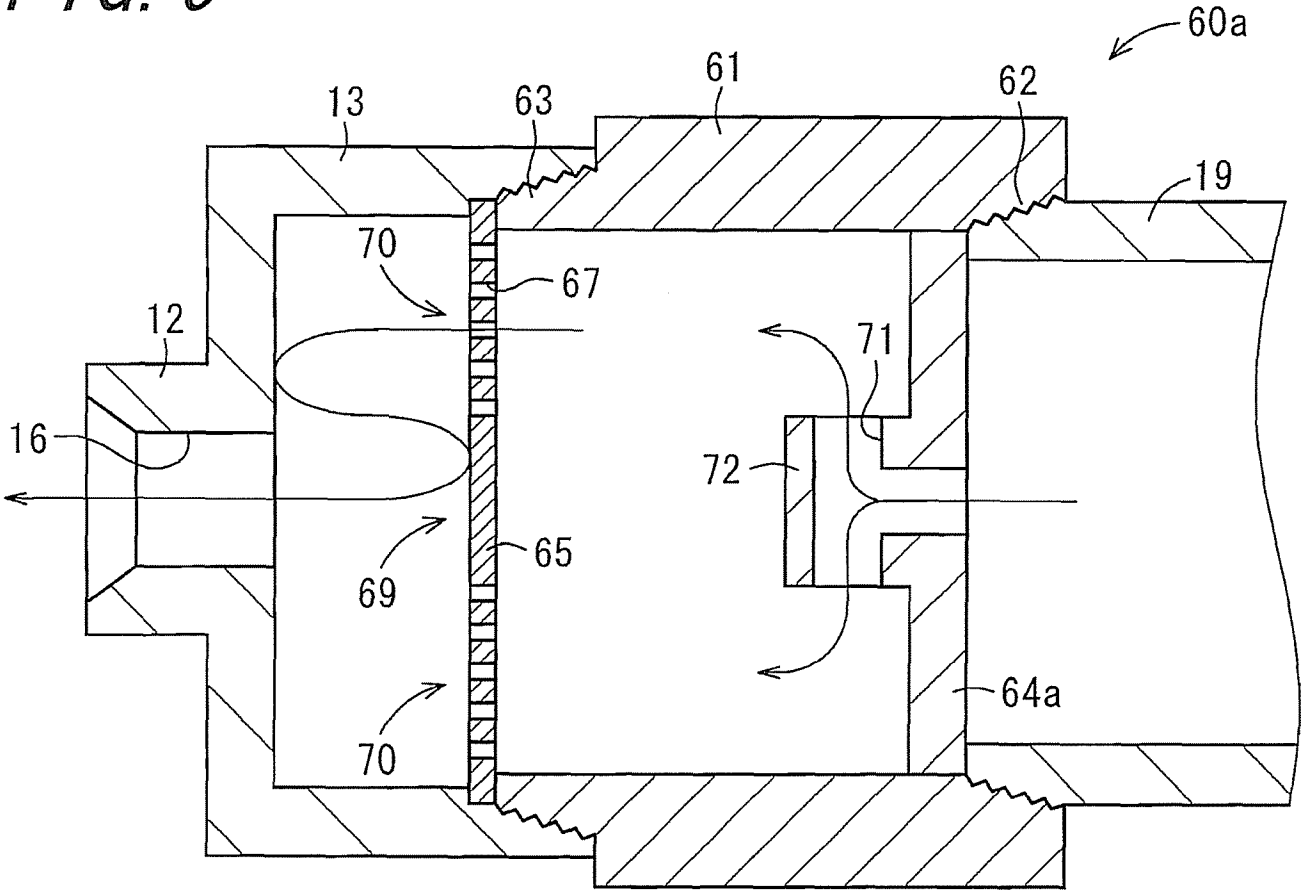
FIG. 9 is an enlarged cross-sectional view illustrating a silencer 60*a* included in a gas fire-extinguishing apparatus according to yet another embodiment of the invention.

FIG. 9 is an enlarged cross-sectional view illustrating a silencer 60*a* included in a gas fire-extinguishing apparatus according to yet another embodiment of the invention. In addition, portions corresponding to the above-described embodiment are denoted by the same reference numerals. The silencer 60*a* of the embodiment has a cylindrical peripheral wall 61, a mounting section 62 which is detachably formed on the branch pipe 19 at one end in the axial direction of the peripheral wall 61, a mounting section 63 detachably formed on an ejection head 13 at the other end in the axial direction of the peripheral wall 61, an end wall 64*a* formed at one end in the axial direction of the peripheral wall 61 to be perpendicular to the axis of the peripheral wall 61, and an end wall 65 formed at the other end in the axial direction of the peripheral wall 61 to be perpendicular to the axis of the peripheral wall 61.

A guide section 72 is formed in the end wall 64*a* so as to be on the axis of the peripheral wall 61 and face an inner space of the peripheral wall 61, wherein the guide section 72 has a plurality of nozzle holes 71 which eject the high-pressure fire-extinguishing gas supplied from the branch pipe 19 to the inner space defined by the peripheral wall 61 and the end walls 64*a* and 65. The plurality of nozzle holes 71 of the guide section 72 are formed to be spaced at equal angles in the axial direction of the peripheral wall 61 and are on an axis thereof orthogonal to the axis of the peripheral wall 61. The plurality of penetrating holes 67 are formed so as to penetrate the end wall 65 in a thickness direction thereof. The plurality of penetrating holes 67 are formed in a peripheral section 70 remaining except the center section 69 of the end wall 65, the center of which is on the axis of the peripheral wall 61. The end wall 65 is made of, for example, the punching metal. In the embodiment shown in FIG. 9, the penetrating holes 67 are not formed in the center section 69 of the end wall 65, however, the penetrating holes 67 may be formed in the center section 69 of the end wall 65.

According to the silencer 60*a* as described above, the fire-extinguishing gas ejected at high speed from the nozzle holes 71 of the guide section 72 formed in the end wall 64*a* impacts on the inner peripheral surface of the peripheral wall 61 within the silencer 60*a*, the flow, speed thereof is attenuated, and then the gas is ejected from the plurality of penetrating holes 67 formed in the end wall 65 within the space defined by the end wall 65 and the ejection head 13, the gas is ejected from the nozzle hole 16 formed in the nozzle section 12 to the outside. Since the silencer 60*a* expands the fire-extinguishing gas ejected at high speed from the nozzle holes 71 into the space within the silencer 60, the flow speed thereof is decreased in the penetrating holes 67 formed in the end wall 65 and thereby the occurrence of sound caused by ejection of the fire-extinguishing gas from the nozzle hole 16 can be suppressed.

Figure 10:
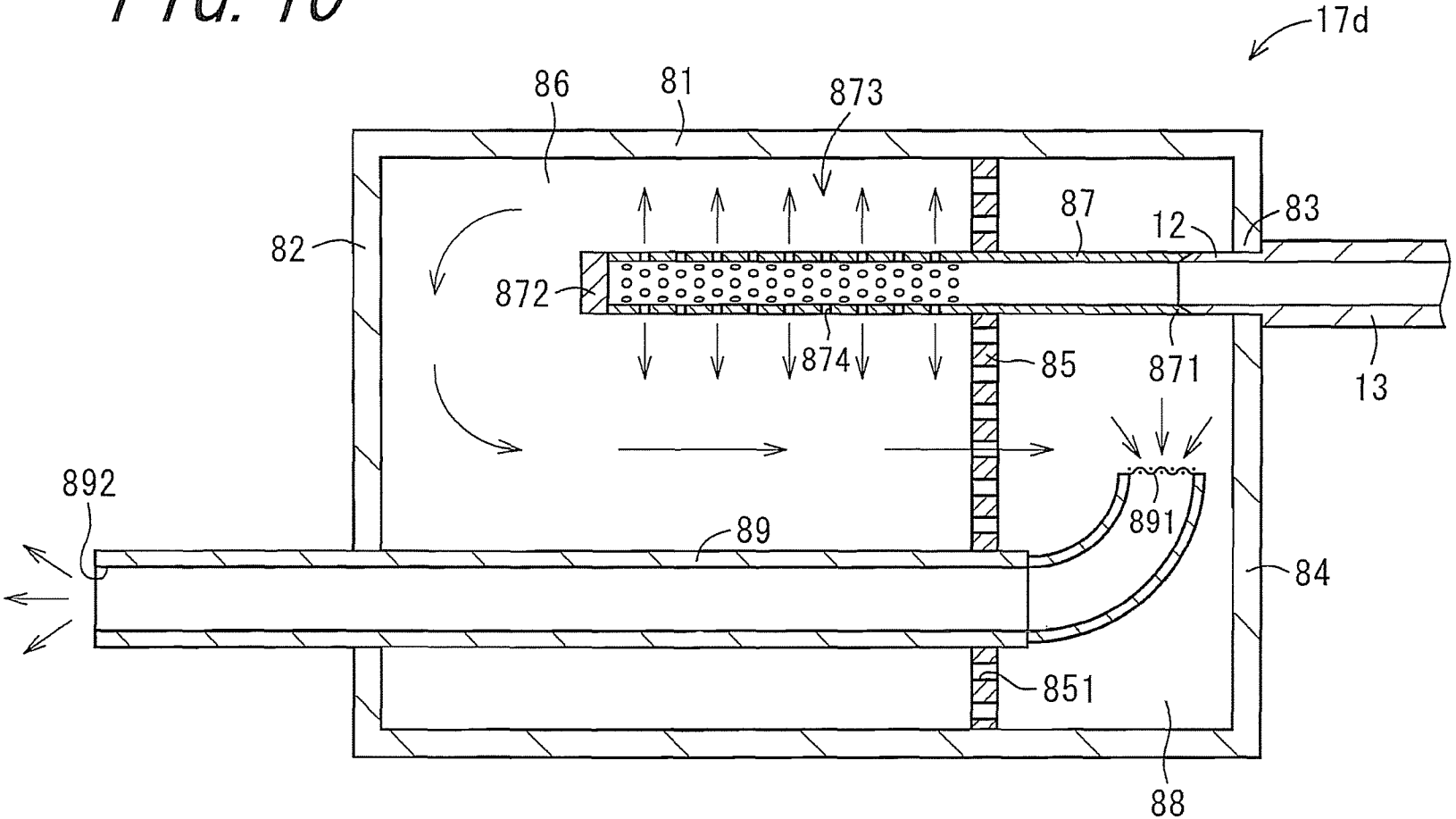
FIG. 10 is an enlarged cross-sectional view illustrating a silencer 17*d* included in a gas fire-extinguishing apparatus according to yet another embodiment of the invention.

FIG. 10 is an enlarged cross-sectional view illustrating a silencer 17*d* included in a gas fire-extinguishing apparatus according to yet another embodiment of the invention. The silencer 17*d* is, for example, attached to an ejection head 13 disposed on a wall surface of the fire-extinguishing area to be suitably used.

In addition, portions corresponding to the above-described embodiment are denoted by the same reference numerals. The silencer 17*d* of the embodiment has a cylindrical peripheral wall 81, an end wall 82 which is formed at one end in the axial direction of the peripheral wall 81 to be perpendicular to the axis of the peripheral wall 81, and a mounting section 83 detachably formed on the ejection head 13. The silencer 17*d* also includes an end wall 84 formed at the other end in the axial direction of the peripheral wall 81 to be perpendicular to the axis of the peripheral wall 81, a barrier 85 formed between the end wall 82 and the end wall 84 to be perpendicular to the axis of the peripheral wall 81, a cylindrical conduction pipe 87 which guides fire-extinguishing gas ejected from the ejection head 13 to a silencing chamber 86 which is an inner space defined by the peripheral wall 81, the end wall 82 and the barrier 85, and a cylindrical vent pipe 89 which guides fire-extinguishing gas within a silencing chamber 88 which is the inner space defined by the peripheral wall 81, the end wall 84 and the barrier 85 to the outside of the silencer 17*d*.

The peripheral wall 81, the end wall 82 and the end wall 84 are made of, for example, the sound absorption material. A plurality of penetrating holes 851 are formed so as to penetrate the barrier 85 in a thickness direction thereof. The barrier 85 is made of, for example, the punching metal.

The conduction pipe 87 is disposed to penetrate the barrier 85 and protrude into the silencing chamber 86. A connection section 871 which is detachably connected to the ejection head 13 is formed at one end in the axial direction of the conduction pipe 87, and an end plate 872 is formed at the other end in the axial direction of the conduction pipe 87. A plurality of penetrating holes 874 are in a portion 873 projected to the silencing chamber 86 of the peripheral wall of the conduction pipe 87 so as to penetrate the peripheral wall of the conduction pipe 87 in a thickness direction thereof. A portion 873 in which the plurality of penetrating holes 874 of the conduction pipe 87 are formed is made of, for example, the punching metal. The vent pipe 89 is disposed penetrating the barrier 85 and the end wall 82, a wire mesh 891 is disposed in an opening of the silencing chamber 88 side, and the fire-extinguishing gas is ejected from a fire-extinguishing gas ejection port 892 which is an opening to the outside. The material of the vent pipe 89 is, for example, vinyl chloride.

According to the silencer 17*d* as described above, the fire-extinguishing gas ejected at high speed from the plurality of penetrating holes 874 formed in the conduction pipe 87 to the silencing chamber 86 is ejected from the plurality of penetrating holes 851 formed in the barrier 85 to the silencing chamber 88. The fire-extinguishing gas ejected from the penetrating holes 851 to the silencing chamber 88 is ejected to the outside of the silencer 17*d* via a vent pipe 89. The silencer 17*d* is configured such that the fire-extinguishing gas ejected at high speed from a plurality of the penetrating holes 874 is expanded in the space within the silencing chamber 86 and in the space within the silencing chamber 88 so that the flow speed thereof is decreased in the vent pipe 89 and the occurrence of sound caused by ejection of the fire-extinguishing gas from the vent pipe 89 can be suppressed.

TABLE 1

| | Hole diameter (mm) | Pressure | Flow speed (m/s) |
|---|---|---|---|
| Example 1 | 50 | 1.5 atmosphere | 250 |
| Example 2 | 80 | 1.1 atmosphere | 100 |

Table 1 is a calculation example of the pressure and the flow speed with respect to Examples 1 and 2 of the gas fire-extinguishing apparatus using the silencer 17*d*. In Example 1, a hole diameter of the vent pipe 89 of the silencer 17*d* is 50 mm, whereas in Example 2, a hole diameter of the vent pipe 89 of the silencer 17*d* is 80 mm. The pressure is the pressure of the silencing chamber 86 and the flow speed (m/s) is the flow speed at the fire-extinguishing gas ejection port 892 of the vent pipe 89.

The flow speed when the fire-extinguishing gas at two atmospheres is ejected in the air at one atmosphere, is about 340 m/s, and a large sound occurs. By decreasing the pressure within the silencing chamber 86, the flow speed at the fire-extinguishing gas ejection port 892 is decreased and the volume of the sound can be decreased. In Example 1, the pressure within the silencing chamber 86 is about 1.5 atmospheres, and the flow speed at the fire-extinguishing gas ejection port 892 is about 250 (m/s). In Example 2, the pressure within the silencing chamber 86 is about 1.1 atmospheres, and the flow speed at the fire-extinguishing gas ejection port 892 is about 100 (m/s).

Figure 11:
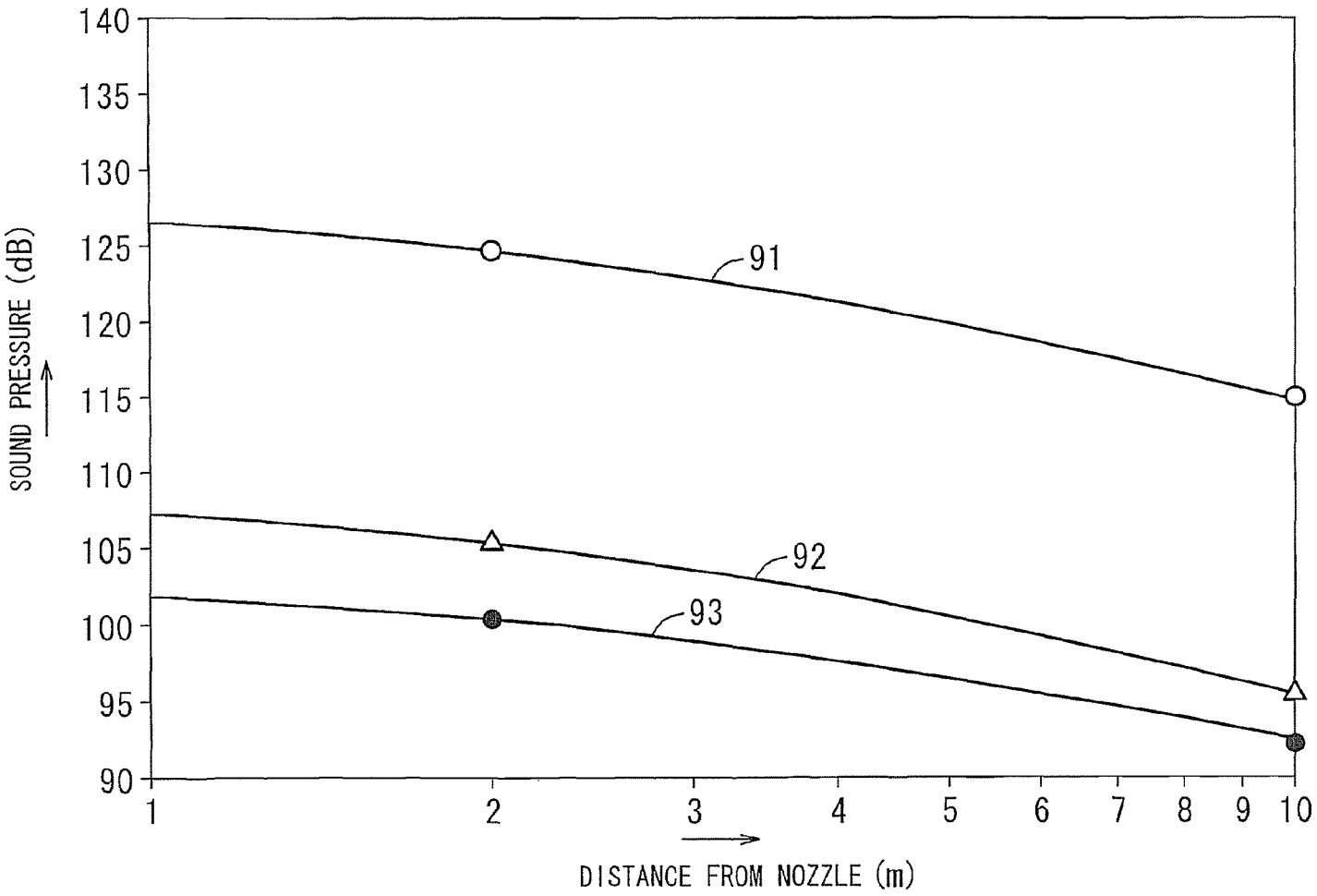
FIG. 11 is a graph for explaining a silencing effect by a silencer 17*d;*

FIG. 11 is a graph for explaining the silencing effect by the silencer 17*d*. The vertical axis is the sound pressure (dB) and the horizontal axis is the distance (m) from the nozzle section 12. The graph 91 is a graph in a case where the silencer is not used, the graph 92 is a graph in a case of Example 1 and the graph 93 is a graph in a case of Example 2.

At a position where the distance from the nozzle section 12 is 2 (m), in a case where the silencer is not used, the sound pressure is about 125 dB, however, in Example 1, the sound pressure decreases to about 105 dB and in Example 2, the sound pressure decreases to about 100 dB. Similarly, at a position where the distance from the nozzle section 12 is 10 (m), in a case where the silencer is not used, the sound pressure is about 115 dB, however, in Example 1, the sound pressure decreases to about 96 dB and in Example 2, the sound pressure decreases to about 92 dB. In other words, in Example 1, the sound pressure can be decreased by about 20 dB and in Example 2, the sound pressure can be decreased by about 25 dB compared to the case where the silencer is not used.

Figure 12:
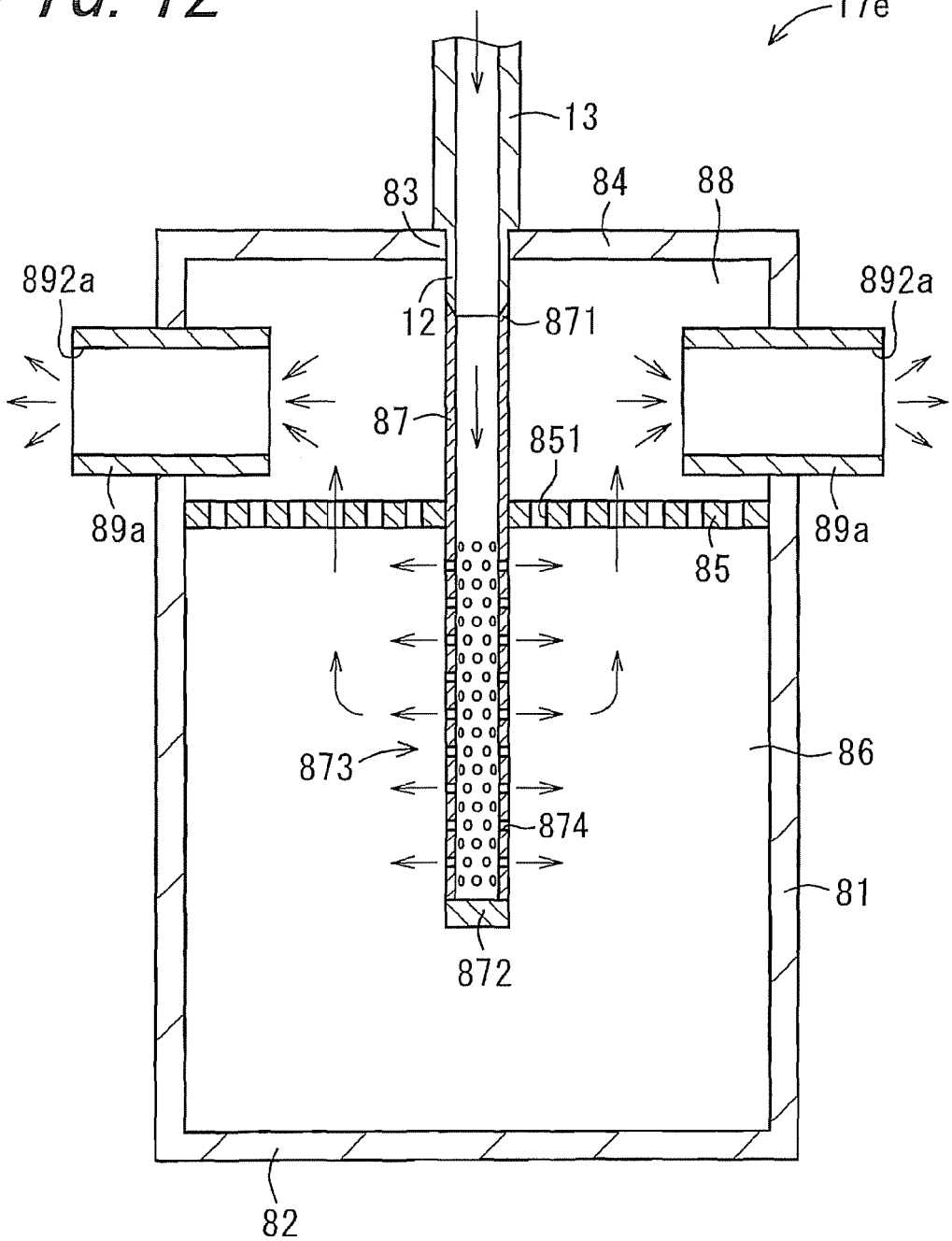
FIG. 12 is an enlarged cross-sectional view illustrating a silencer 17*e* included in a gas fire-extinguishing apparatus according to yet another embodiment of the invention.

FIG. 12 is an enlarged cross-sectional view illustrating a silencer 17*e* included in a gas fire-extinguishing apparatus according to yet another embodiment of the invention. The silencer 17*e* is attached to, for example, the ejection head 13 disposed on the ceiling of the fire-extinguishing area to be suitably used. In addition, portions corresponding to the above-described embodiment are denoted by the same reference numerals. The silencer 17*e* of the embodiment has the cylindrical peripheral wall 81, the end wall 82 formed at one end in the axial direction of the peripheral wall 81 to be perpendicular to the axis of the peripheral wall 81, and a mounting section 83 detachably formed on the ejection head 13. The silencer 17*e* also includes an end wall 84 formed at the other end in the axial direction of the peripheral wall 81 to be perpendicular to the axis of the peripheral wall 81, the barrier 85 formed between the end wall 82 and the end wall 84 to be perpendicular to the axis of the peripheral wall 81, a cylindrical conduction pipe 87 which guides fire-extinguishing gas ejected from the ejection head 13 to a silencing chamber 86 which is an inner space defined by the peripheral wall 81, the end wall 82 and the barrier 85, and a plurality of cylindrical vent holes 89*a* which guide the fire-extinguishing gas within a silencing chamber 88 which is the inner space defined by the peripheral wall 81, the end wall 84 and the barrier 85 to the outside of the silencer 17*e*.

The peripheral wall 81, the end wall 82 and the end wall 84 are for example, made of the sound absorption material. The plurality of penetrating holes 851 are formed so as to penetrate the barrier 85 in a thickness direction thereof. The barrier 85 is made of, for example, the punching metal.

The conduction pipe 87 penetrates the barrier 85 and is disposed to protrude to the silencing chamber 86. The connection section 871 which is detachably connected to the ejection head 13 is formed at one end in the axial direction of the conduction pipe 87, and the end plate 872 is formed at the other end in the axial direction of the conduction pipe 87. The plurality of penetrating holes 874 are formed in the portion 873 which is projected to the silencing chamber 86 of the peripheral wall of the conduction pipe 87 so as to penetrate the peripheral wall of the conduction pipe 87 in a thickness direction thereof. The portion 873 in which the plurality of penetrating holes 874 of the conduction pipe 87 are formed is made of, for example, the punching metal. The plurality of vent pipes 89*a* are disposed to be spaced at equal angles in the peripheral direction with respect to the axis of the peripheral wall 81 and are on an axis orthogonal to the axis of the peripheral wall 81 which is formed so as to penetrate the peripheral wall 81 respectively. A fire-extinguishing gas ejection port 892*a* which is an opening to the outside of the silencer 17*e* is formed in each vent pipe 89*a* and the fire-extinguishing gas ejects from each fire-extinguishing gas ejection port 892*a* to the outside of the silencer 17*e*. The material of the vent pipes 89*a* for example, is vinyl chloride.

According to the silencer 17*e* as described above, the fire-extinguishing gas is ejected from the plurality of penetrating holes 851 formed in the barrier 85 to the silencing chamber 88, wherein the fire-extinguishing gas ejected at high speed from the plurality of penetrating holes 874 formed in the conduction pipe 87 to the silencing chamber 86. The fire-extinguishing gas ejected from the penetrating holes 851 to the silencing chamber 88 is ejected to the outside of the silencer 17*e* via the vent pipes 89*a*. Since the silencer 17*e* is configured such that the fire-extinguishing gas ejected at high speed from the plurality of penetrating holes 874 is expanded in the space within the silencing chamber 86 and the space within the silencing chamber 88 so that the flow speed in the vent holes 89*a* is decreased, the occurrence of sound caused by ejection of the fire-extinguishing gas from the vent pipes 89*a* is suppressed.

Figure 13:
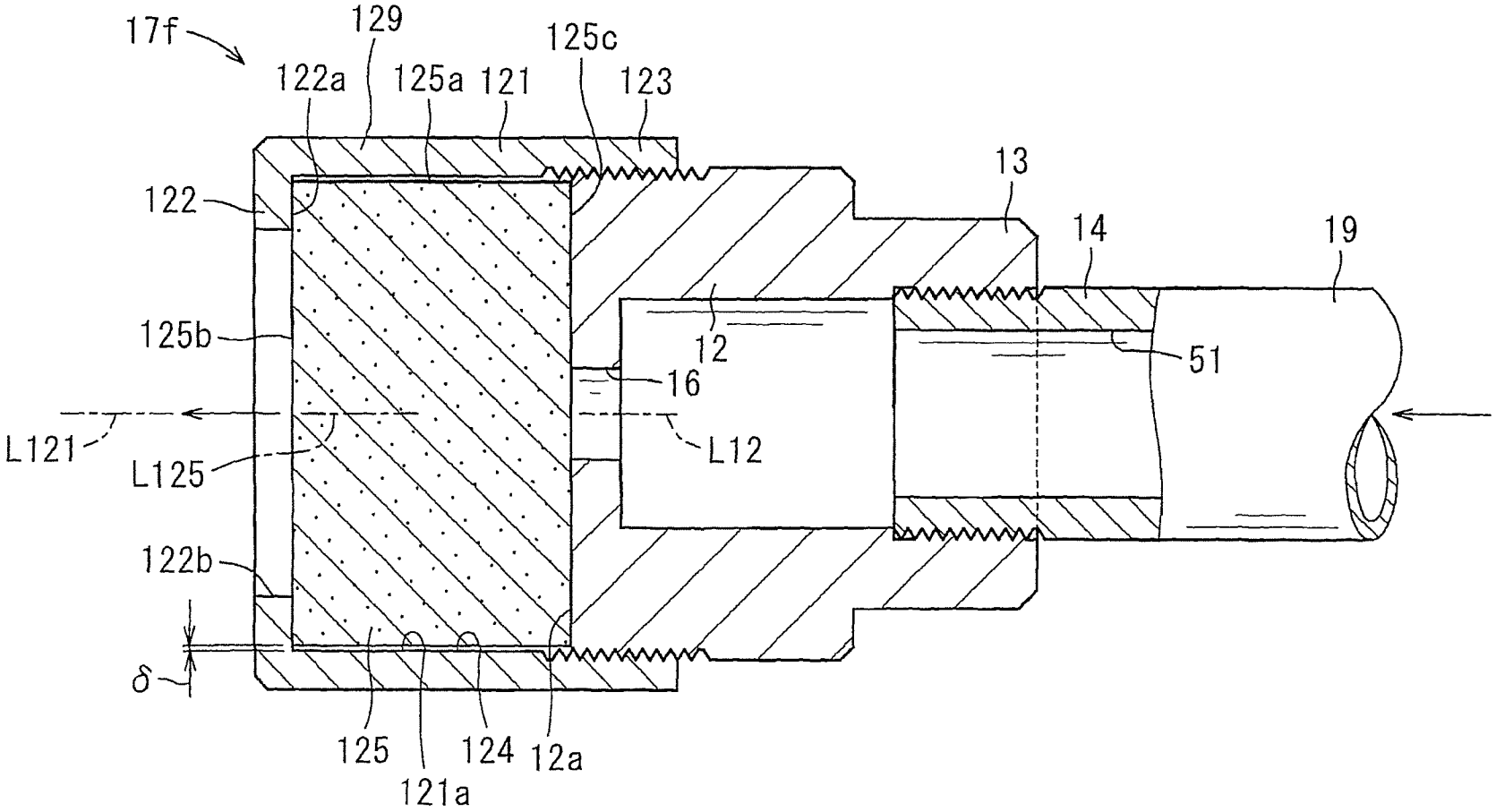
FIG. 13 is an enlarged cross-sectional view illustrating a silencer 17*f* included in a gas fire-extinguishing apparatus according to yet another embodiment of the invention.

FIG. 13 is an enlarged cross-sectional view illustrating a silencer 17*f* included in a gas fire-extinguishing apparatus according to yet another embodiment of the invention. In addition, portions corresponding to the above-described embodiment are denoted by the same reference numerals. The silencer 17*f* is, for example, attached to the ejection head 13 disposed on the wall surface of the fire-extinguishing area to be suitably used.

The silencer 17*f* of the embodiment has a cylindrical peripheral wall 121, an annular the end wall 122 formed at one end in the axial direction of the peripheral wall 121 to be perpendicular to the axis of the peripheral wall 121, and a mounting section 123 formed at the other end in the axial direction of the peripheral wall 121 and detachably formed on the ejection head 13. A silencing chamber 124 is formed in the silencer 17*f* wherein the silencing chamber 124 is an inner space defined by the ejection head 13, the peripheral wall 121 and the end wall 122. A columnar sound absorption material 125 is mounted along the inner peripheral surface of the peripheral wall 121 and accommodated in the silencing chamber 124. A casing 129 is constituted by the peripheral wall 121, the end wall 122 and the mounting section 123.

A inner peripheral surface 121*a* of the peripheral wall 121 facing the silencing chamber 124 of the casing 129 is cylindrically formed and an inner surface 122*a* of the end wall 122 facing the silencing chamber 124 is formed on an imaginary plane perpendicular to an axis L121 of the peripheral wall 121. A penetrating hole 122*b* is formed so as to penetrate the end wall 122 in a direction of the axis L121, the center of which is on the axis L121 of the peripheral wall 121.

The sound absorption material 125 is formed in a columnar shape and an outer peripheral surface 125*a* of which is formed in a cylindrical shape. An end surface 125*b* of one side of the sound absorption material 125 in a direction of an axis L125 of the sound absorption material 125 and an end surface 125*c* of the other side are formed on an imaginary plane perpendicular to the axis L125. An end surface 12*a* of the nozzle section 12 of the ejection head 13 on the downstream side of the fire-extinguishing gas ejection direction is formed on an imaginary plane perpendicular to an axis L12 of the nozzle section 12.

The silencer 17*f* is charged in the space within the casing 129 from the mounting section 123 in a posture in which the axis L125 of the sound absorption material 125 is aligned or substantially aligned with the axis L121 of the peripheral wall 121. For example, if the sound absorption material 125 is a right cylindrical shape, the sound absorption material 125 is detachably configured by screwing an outside screw threaded in the outer peripheral portion of the nozzle section 12 on the downstream side of the fire-extinguishing gas ejection direction to an inside screw threaded in the inner peripheral portion of the mounting section 123. In the silencer 17*f*, the sound absorption material 125 is accommodated in the silencing chamber 124 in a state where one side the end surface 125*b* and the inner surface 122*a* of the end wall 122 are surface-contacted with each other and the other side the end surface 125*c* and the end surface 12*a* of the nozzle section 12 are surface-contacted with each other. In other words, the sound absorption material 125 fills the silencing chamber 124 without a gap. In the embodiment, the hole diameter of the penetrating hole 122*b* is formed in a size that the fire-extinguishing agent can be effectively ejected. In addition, the effective hole diameter portion of the penetrating hole 122*b* may be not only on the end wall surface side but also on the peripheral wall surface side. Since the effective area of the portion of the end wall surface side can be decreased by disposing the effective hole diameter portion in the peripheral wall surface, the silencer 17*f* can be decreased in size. In addition, the silencer 17*f* can also be decreased in size by charging the sound absorption material 125 in the space within the casing 129 without a gap.

The sound absorption material 125 is made of the porous metal in which columnar air gaps are continuous. Since the silencer 125 as described above, is disposed immediately after the nozzle hole 16, the silencer 17*f* gradually, expands the fire-extinguishing gas supplied from the branch pipe 19 with the decreased pressure and the flow speed thereof can be decreased. Accordingly, the occurrence of ejection sound caused by the ejection of the fire-extinguishing gas can be suppressed.

Specifically, since the sound absorption material 125 fills the silencing chamber 124 without a gap, the fire-extinguishing gas ejected from the nozzle hole 16 can be directly flowed in the porous metal which is the sound absorption material 125 and the fire-extinguishing gas flowed in the porous metal can be directly ejected from the penetrating hole 122*b*. As described above, since the fire-extinguishing gas ejected from the nozzle hole 16 is directly flowed in the sound absorption material 125, the fire-extinguishing gas is excessively expanded immediately after being ejected from the nozzle hole 16 and the fire-extinguishing gas is flowed in the sound absorption material 125 before a shock wave is generated and thereby the fire-extinguishing gas is decelerated and spreads rapidly. Accordingly, the occurrence of strong turbulence with the shock wave is prevented and noise is suppressed. In addition, since the fire-extinguishing gas is dispersed by the fine air gaps of the sound absorption material 125, the flow speed of the fire-extinguishing gas ejected from the sound absorption material 125 to the outside via penetrating hole 122*b* is attenuated, and thereby the noise is also suppressed without a large shock wave being generated. Thus, rapid expansion of the fire-extinguishing gas with the decreased pressure can be suppressed compared to a case where the end surface 12*a* of the nozzle section 12 is separated from the end surface 125*c* of the sound absorption material 125, and further rapid expansion of the fire-extinguishing gas with the decreased pressure can be suppressed compared to a case where the inner surface 122*a* of an end wall 111 is separated from the end surface 125*b* of the sound absorption material 125.

As described above, since the silencer 17*f* of the embodiment is gradually expanded with decreased pressure by the porous metal which is the sound absorption material 125 and the flow speed can be decreased, the occurrence of ejection sound caused by the ejection of the fire-extinguishing gas can be suppressed. Furthermore, since the silencer 17*f* is configured to suppress rapid expansion of the fire-extinguishing gas with decreased pressure, the occurrence of noise caused by the rapid expansion with decreased pressure can be suppressed.

Figure 14:
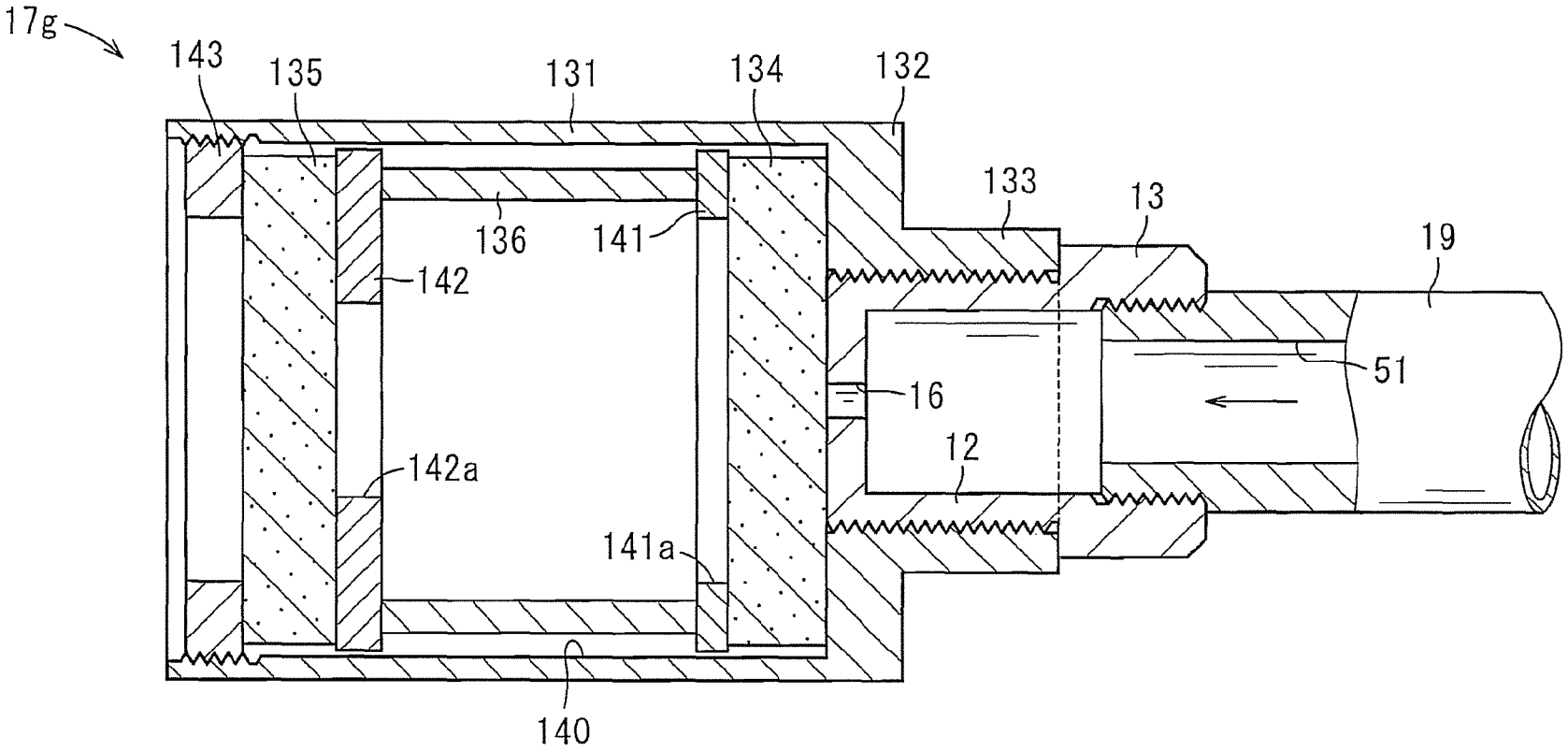
FIG. 14 is an enlarged cross-sectional view illustrating a silencer 17*g* included in a gas fire-extinguishing apparatus according to yet another embodiment of the invention.

FIG. 14 is an enlarged cross-sectional view illustrating a silencer 17*g* included in a gas fire-extinguishing apparatus according to yet another embodiment of the invention. In addition, portions corresponding to the above-described embodiment are denoted by the same reference numerals. In the embodiment, the silencer 17*g* is mounted for example, on the ejection head 13 disposed in a wall surface of the fire-extinguishing area.

The silencer 17*g* of the embodiment has a cylindrical peripheral wall 131, an end wall 132 formed at the other end in the axial direction of the peripheral wall 131 to be perpendicular to the axis of the peripheral wall 131, and a mounting section 133 continuously formed in the end wall 132 and detachably formed on the ejection head 13. An inside screw is threaded in the inner peripheral surface of the peripheral wall 131 at one end in the axial direction. A silencing chamber 140 which is an inner space defined by the peripheral wall 131, the end wall 132 and the ejection head 13 is formed in the silencer 17*g*.

The silencing chamber 140 accommodates a columnar first sound absorption material 134 disposed at one end in the axial direction of the peripheral wall, a columnar second sound absorption material 135 disposed at the other end in the axial direction of the peripheral wall, a cylindrical third sound absorption material 136 disposed between the first sound absorption material 134 and the second sound absorption material 135, an annular end plate 141 supporting the first sound absorption material 134, an annular spacer 142, and a nut 143.

The first sound absorption material 134 and the second sound absorption material 135 are made of planar columnar porous metal. The first sound absorption material 134 is accommodated as mounting at one end in the axial direction of the peripheral wall 131 along the inner peripheral surface and disposed in contact with one surface facing the silencing chamber 140 of the end wall 132 and one end in the axial direction of the ejection head 13.

An annular end plate 141 having a penetrating hole 141*a* is disposed at one end in the axial direction of the first sound absorption material 134. The end plate 141 is disposed in contact with the first sound absorption material 134 and regulates the movement of the first sound absorption material 134 to one end thereof in the axial direction. The third sound absorption material 136 is disposed at one end in the axial direction of the end plate 141. In the embodiment, the third sound absorption material 136 is realized by the same member as the sound absorption material 33 of the above-described silencer 17. In addition, the third sound absorption material 136 may be realized by the porous metal. The third sound absorption material 136 is accommodated to be mounted along the inner peripheral surface of the peripheral wall 131.

An annular spacer 142 having a penetrating hole 142*a* is disposed at one end in the axial direction of the third sound absorption material 136. The spacer 142 is disposed in contact with the second sound absorption material 135 and holds the interval between the third sound absorption material 136 and the second sound absorption material 135.

The second sound absorption material 135 is disposed at one end in the axial direction of the spacer 142. In the embodiment, the second sound absorption material 135 may be formed in the same shape as the first sound absorption material 134 and may be formed differently from the first sound absorption material 134. The second sound absorption material 135 is accommodated to be mounted along the inner peripheral surface of the peripheral wall 131.

The nut 143 is disposed at one end in the axial direction of the second sound absorption material 135. An outside screw is threaded in the outer peripheral portion of the nut 143 and the nut 143 is fastened in a screwed state to an inside screw threaded in the inner peripheral portion of an opening end side of the peripheral wall 131, and the nut 143 supports the second sound absorption material 135 while pressing it against the other end side in the axial direction thereof. Accordingly, each of the sound absorption materials 134, 135 and 136, the end plate 141 and the spacer 142 are regulated to be displaced to one end side in the axial direction thereof.

According to the embodiment, the silencer 17*g* is disposed as accommodating three sound absorption materials. As described above, since the first sound absorption material 134 is disposed immediately after the nozzle hole 16, the silencer 17*g* is configured such that the fire-extinguishing gas supplied from the branch pipe 19 side is gradually expanded with decreased pressure and the flow speed thereof can be decreased. In addition, since the third sound absorption material 136 is disposed, the sound vibration caused by the ejection flow of the fire-extinguishing gas is absorbed by the third sound absorption material 136 and thereby the occurrence of ejection sound caused by the ejection of the fire-extinguishing gas can be suppressed. In addition, since the second sound absorption material 135 is disposed, the fire-extinguishing gas passing the third sound absorption material 136 can further decrease the pressure and the flow speed thereof can be decreased. Accordingly, the occurrence of ejection sound caused by the ejection of the fire-extinguishing gas can be suppressed.

Figure 15:
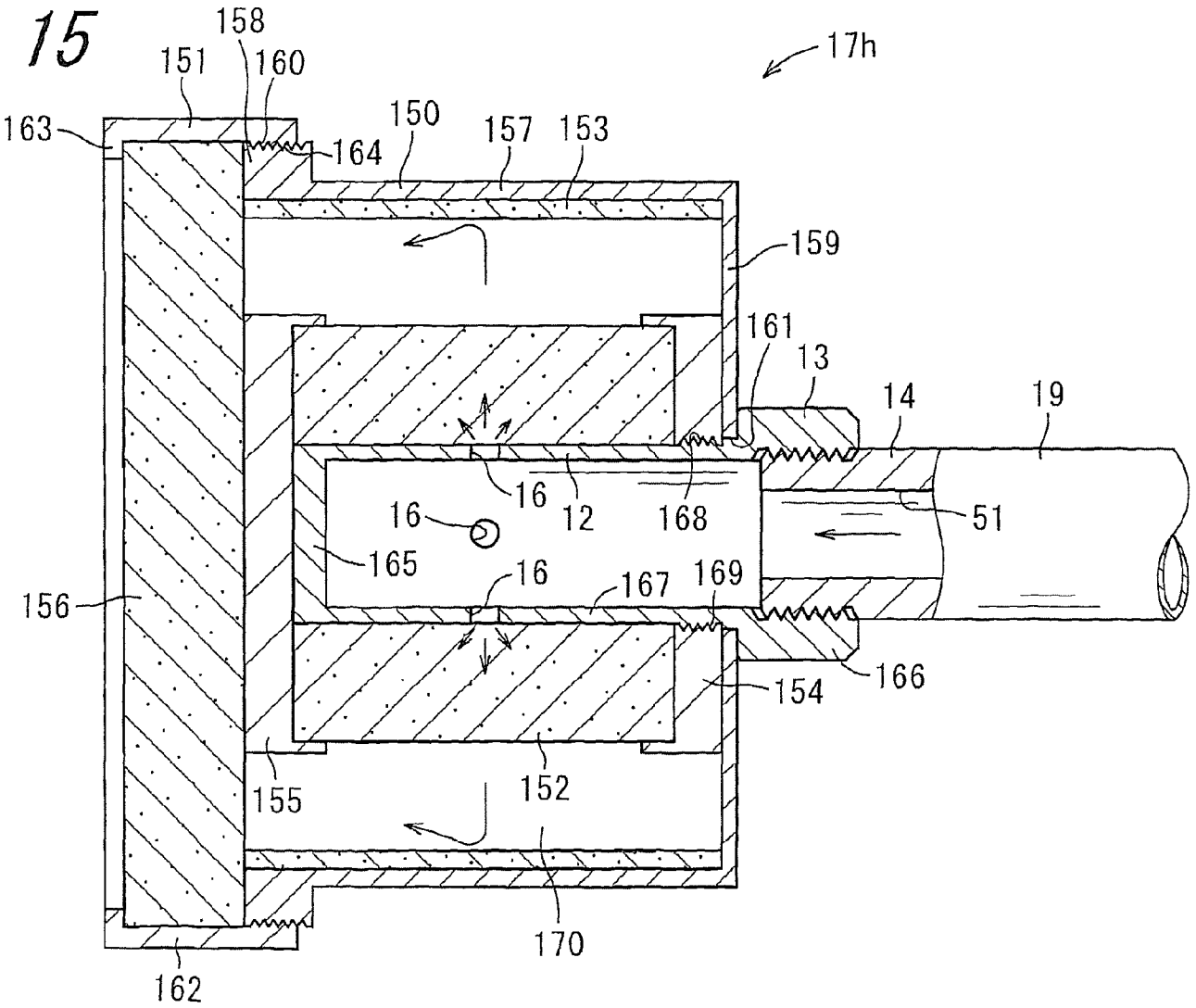
FIG. 15 is an enlarged cross-sectional view illustrating a silencer 17*h* included in a gas fire-extinguishing apparatus according to yet another embodiment of the invention.
Figure 16:
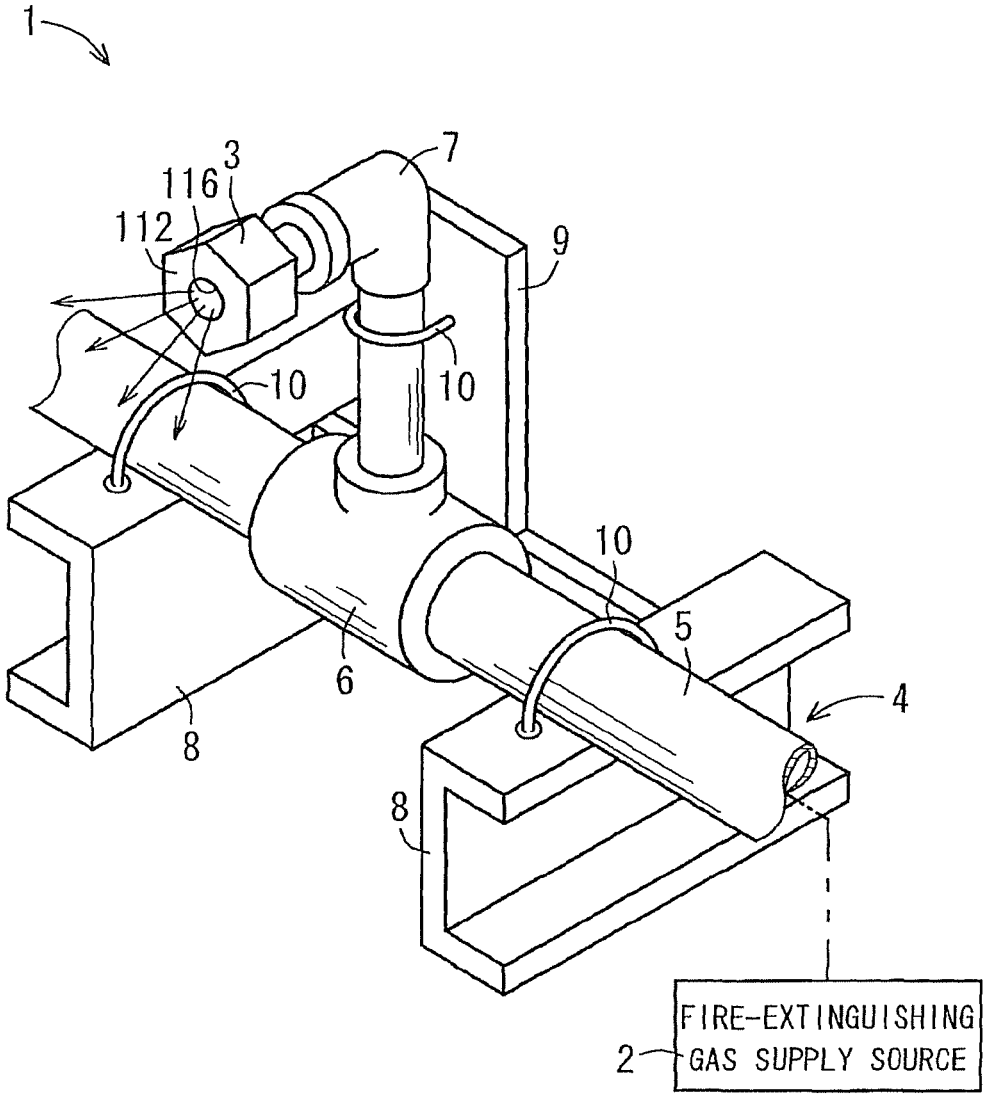
FIG. 16 is a perspective view illustrating a fire-extinguishing gas ejection section 1 used in a gas fire-extinguishing apparatus of the related art.

FIG. 15 is an enlarged cross-sectional view illustrating a silencer 17*h* included in a gas fire-extinguishing apparatus according to yet another embodiment of the invention. In addition, portions corresponding to the above described embodiment are denoted by the same reference numerals. In the embodiment, the silencer 17*h* is mounted, for example, on the branch pipe 19 disposed in a wall surface of the fire-extinguishing area via an ejection head 13.

The silencer 17*h* of the embodiment includes the ejection head 13, a bottomed cylindrical casing 150, a nut 151 which is screwed to an opening of the casing 150, a cylindrical first sound absorption material 152 mounted on the ejection head 13, a cylindrical second sound absorption material 153 accommodated in the casing 150 and disposed along the inner peripheral surface of the casing 150, an annular-shaped first supporting piece 154 mounted on a base end section of the ejection head 13 within the casing 150, a disk-shaped second supporting piece 155 disposed in contact with the end surface of the ejection head 13 on the opening side within the casing 150, and a disk-shaped third sound absorption material 156 held in a supported state in the opening of the casing 150 by the nut 151.

The casing 150 has a right cylindrical section 157, a flange section 158 projecting perpendicularly from one end in the axial direction of the cylindrical section 157 radially and outwardly, and an annular the end wall 159 extending from the other end in the axial direction of the cylindrical section 157 radially and inwardly. An outside screw 160 is threaded in an outer peripheral portion of the flange section 158. An insertion hole 161 is formed in the end wall 159 in which the base end section of the ejection nozzle 13 is inserted on the center axis thereof. The casing 150 as described above, is made of metal. In addition, the first to the third sound absorption materials 152, 153 and 156 are made of the porous metal as described above.

The nut 151 has a right cylindrical section 162 and a flange section 163 projecting from one end in the axial direction of the cylindrical section 162 radially and inwardly. An inside screw 164 is threaded in the inner peripheral surface of the other end in the axial direction of the cylindrical section 162 and screwed to an outside screw 160 of the casing 150. The nut 151, as described above, is made of metal. The nut 151 is screwed to the outside screw 160 of the casing 150 so that the peripheral section of the third sound absorption material 156 is pinched by the flange section 158 of the casing 150 and the flange section 163 of the nut 151, and at the same time, the second supporting piece 155 is pinched by the third sound absorption material 156 and the end wall 165 of the ejection head 13, and thereby ejection thereof from the casing 150 of a second sound absorption material 153 is prevented.

The ejection head 13 has an engaging section 166 in which a fastening tool such as spanner is engaged, a cylindrical section 167 extended to the engaging section 166 in the axial direction thereof, and the end wall 165 which closes one end in the axial direction of the cylindrical section 167. The nozzle holes 16 are formed in the cylindrical section 157 so as to penetrate in a thickness direction thereof at intervals of, for example, every 90° in a peripheral direction thereof. An outside screw 168 is threaded in the base section near the engaging section 166 of the cylindrical section 167. An inside screw 169 threaded in the inner peripheral surface of the first supporting piece 154 is screwed to the outside screw 168 and the end wall 159 of the casing 150 is pinched by the second supporting piece 155 and the engaging section 166, and the ejection head 13 is fixed to the casing 150 on the same axis. As described above, in a state where the first sound absorption material 152 is mounted on the ejection head 13, in other words, in a state where the first sound absorption material 152 is mounted on the cylindrical section 12 within the casing 150, the first sound absorption material 152 is held in a pinched state by the first and the second supporting pieces 154 and 155 from both sides in the axial direction. In the silencer 17*h* as described above, an annular space 170 is formed between the first sound absorption material 152 and the second sound absorption material 153 through the end wall 159 of the casing 150 and the third sound absorption material 156.

The high-pressure fire-extinguishing gas supplied from the branch pipe 19 to the ejection head 13 is ejected from each the nozzle hole 16 of the ejection head 13 within the first sound absorption material 152, and the shock wave thereof is rapidly dispersed and decelerated, so that the occurrence of strong turbulence with the shock wave is prevented and the sound can be decreased. The fire-extinguishing gas ejected from the first sound absorption material 152 to the space 170 enters the second sound absorption material 153 and thereby the gas rapidly dispersed and decelerated similar to the first sound absorption material 152, and is reflected by the inner peripheral surface of the casing 150 and directed to the third sound absorption material 156. The fire-extinguishing gas having entered the third sound absorption material 156 is dispersed and decelerated before being rapidly expanded similar to the above-described first and second sound absorption materials 152 and 153, so that the sound is further decreased and ejection sound caused by the ejection of the fire-extinguishing gas can be particularly decreased.

In the embodiment shown in FIG. 15, the plurality of ejection nozzles 16 are formed in the cylindrical section 12 of the ejection head 13 to be perpendicular to the axial direction thereof and thereby the fire-extinguishing gas is ejected radially and outwardly, however, in yet another embodiment of the invention, the nozzle holes 16 inclined to the opening of the casing 150 may be formed in the cylindrical section of the ejection head 13 and thereby the gas passing the first sound absorption material 152 may be ejected to the third sound absorption material 156 as it is. Even such constitution can obtain the same advantage.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

REFERENCE SIGNS LIST

11: Gas ejection section
12: Nozzle section
13, 50, 50*a*: Ejection head
14: Conduit pipe
15: Fire-extinguishing gas supply source
16, 71: Nozzle hole
17, 17*a*-17*h*, 60, 60*a*: Silencer
18: Diverging pipe
19: Branch pipe
20: Base
21: Bracket
22: Fastener
23: Main pipe
25, 35, 41, 61, 81: Peripheral wall
26, 36, 42, 64, 64*a*, 65, 82, 84: End wall
27, 37, 43, 62, 63, 83, 123: Mounting section
28: Portion facing downstream side in ejection direction
29: Inner cylinder
30, 66, 67, 851, 874: Penetrating hole
31: Cylinder section
32, 872: End plate
33: Sound absorption material

34: Gas ejection hole
38, 44: Vent hole
39, 45: Inner space
40, 46: Sound absorption material
51, 52: Inner peripheral surface
55: Edge section
72: Guide section
85: Barrier
86, 88: Silencing chamber
87: Conduction pipe
89, 89*a*: Vent pipe
125: Sound absorption material
134: First sound absorption material
135: Second sound absorption material
136: Third sound absorption material
871: Connection section
891: Wire mesh
892, 892*a*: Fire-extinguishing gas ejection port
D1, D2: Inner diameter

The invention claimed is:

1. A gas fire-extinguishing apparatus, comprising:

an ejection head having a nozzle section which ejects high-pressure fire-extinguishing gas to a space;

a conduit pipe which is connected to the ejection head and guides high-pressure fire-extinguishing gas to the ejection head;

a fire-extinguishing gas supply source which supplies the high-pressure fire-extinguishing gas to the conduit pipe; and a silencer which is detachably mounted on an exterior peripheral surface of the ejection head and attenuates sound caused by ejection of the fire-extinguishing gas from the nozzle section, wherein the silencer comprises a cylindrical peripheral wall, an end wall formed at one end in an axial direction of the peripheral wall to be perpendicular to an axis of the peripheral wall, and a mounting section integrally formed on the cylindrical peripheral wall of the silencer, and a sound absorption material fills substantially an entire inner space defined by the peripheral wall, the end wall and the mounting section, the silencer and the ejection head being threadably engaged with each other through threading on the mounting section of the silencer and threading on the exterior peripheral surface of the ejection head, and wherein the silencer comprises a plurality of vent holes which penetrate the end wall in a thickness direction thereof and the mounting section is detachably formed on the ejection head, and the mounting section has threads formed on an inner and an outer peripheral surface thereof.

2. The gas fire-extinguishing apparatus of claim 1, wherein the sound absorption material which is accommodated in the inner space defined by the peripheral wall, the end wall and the ejection head, is made of a porous metal.

3. A structure having a space containing an apparatus in a building, comprising:

an ejection head which faces the space from a surface including any of a ceiling or a wall defining the space, and ejects a high-pressure fire-extinguishing gas from a fire-extinguishing gas supply source; and a silencer which is detachably mounted on an exterior peripheral surface of the ejection head and includes a sound absorption material which expands the fire-extinguishing gas immediately after being ejected from the ejection head to the space to decelerate and spread the fire-extinguishing gas rapidly and thereby the sound absorption material prevents a shock wave from being generated and ejects the high-pressure fire-extinguishing gas to the space therethrough, the silencer and the ejection head being threadably engaged with each other through threading on a mounting section of the silencer and threading on the exterior peripheral surface of the ejection head, wherein the silencer comprises a plurality of vent holes which penetrate an end wall of the silencer in a thickness direction thereof and the mounting section is detachably formed on the ejection head and integrally formed on a cylindrical peripheral wall of the silencer, and the mounting section has threads formed on an inner and an outer peripheral surface thereof.

4. A gas fire-extinguishing method comprising steps of:

preparing a gas fire-extinguishing apparatus having an ejection head disposed in a structure having a space in a building, facing the space from a surface including any of a ceiling or a wall defining the space, and ejecting a high-pressure fire-extinguishing gas from a fire-extinguishing gas supply source when a fire occurs, a silencer having a plurality of vent holes which penetrate an end wall of the silencer in a thickness direction thereof, the silencer being detachably mounted on an exterior peripheral surface of the ejection head and including a sound absorption material to eject the high-pressure fire-extinguishing gas from the ejection head to the space to decrease 02 concentration within the space and thereby the fire is extinguished, the silencer and the ejection head being threadably engaged with each other through threading on a mounting section of the silencer and threading on the exterior peripheral surface of the ejection head and the mounting section being detachably formed on the ejection head and integrally formed on a cylindrical peripheral wall of the silencer, and the mounting section has threads formed on an inner and an outer peripheral surface thereof; and causing the sound absorption material to expand the fire-extinguishing gas immediately after being ejected from the ejection head to the space to decelerate and spread the fire-extinguishing gas rapidly and thereby the sound absorption material prevents a shock wave from being generated.

5. A gas fire-extinguishing method comprising steps of:

disposing an ejection head in a structure having a space in a building, facing the space from a surface including any of a ceiling or a wall defining the space;

disposing a silencer detachably on an exterior peripheral surface of the ejection head such that the silencer and the ejection head are threadably engaged with each other through threading on a mounting section of the silencer and threading on the exterior peripheral surface of the ejection head, the mounting section being detachably formed on the ejection head and integrally formed on a cylindrical peripheral wall of the silencer, and the mounting section having threads formed on an inner and an outer peripheral surface thereof, the silencer including a plurality of vent holes which penetrate an end wall of the silencer in a thickness direction thereof and a sound absorption material;

ejecting a high-pressure fire-extinguishing gas from the ejection head when a fire occurs;

ejecting the high-pressure fire-extinguishing gas from the ejection head to the space to decrease 02 concentration within the space and thereby the fire is extinguished; and causing the sound absorption material to expand the fire-extinguishing gas immediately after being ejected from the ejection head to the space to decelerate and spread the fire-extinguishing gas rapidly and thereby the sound absorption material prevents a shock wave from being generated.

6. A gas fire-extinguishing apparatus, comprising:

an ejection head disposed in a structure having a space in a building, and facing the space from a surface including any of a ceiling or a wall defining the space, ejecting high-pressure fire-extinguishing gas from a fire-extinguishing gas supply source; and a silencer detachably mounted on an exterior peripheral surface of the ejection head to eject the high-pressure fire-extinguishing gas from the ejection head to the space, the silencer including a plurality of vent holes which penetrate an end wall of the silencer in a thickness direction thereof and a sound absorption material expanding the fire-extinguishing gas immediately after being ejected from the ejection head to decelerate and to spread the fire-extinguishing gas rapidly and thereby the sound absorption material prevents a shock wave from being generated, and the fire-extinguishing gas from the silencer decreases 02 concentration within the space to extinguish a fire, the silencer and the ejection head being threadably engaged with each other through threading on a mounting section of the silencer and threading on the exterior peripheral surface of the ejection head, the mounting section being detachably formed on the ejection head and integrally formed on a cylindrical peripheral wall of the silencer, and the mounting section having threads formed on an inner and an outer peripheral surface thereof.

7. A gas fire-extinguishing apparatus, comprising:

an ejection head disposed in a structure having a space in a building, and facing the space from a surface including any of a ceiling or a wall defining the space, ejecting high-pressure fire-extinguishing gas from a fire-extinguishing gas supply source; and a silencer detachably mounted on an exterior peripheral surface of the ejection head including a plurality of vent holes which penetrate an end wall of the silencer in a thickness direction thereof and a sound absorption material expanding the fire-extinguishing gas immediately after being ejected from the ejection head to decelerate and to spread the fire-extinguishing gas rapidly, to prevent a shock wave from being generated, the fire-extinguishing gas from the sound absorption material decreasing 02 concentration within the space to extinguish a fire, the silencer and the ejection head being threadably engaged with each other through threading on a mounting section of the silencer and threading on the exterior peripheral surface of the ejection head, the mounting section being detachably formed on the ejection head and integrally formed on a cylindrical peripheral wall of the silencer, and the mounting section having threads formed on an inner and an outer peripheral surface thereof.

8. The gas fire-extinguishing apparatus of claim 7, wherein the sound absorption material is disposed to extend in a direction perpendicular to an axis of a nozzle hole which is formed in the ejection head and ejects the high-pressure fire-extinguishing gas.

9. The gas fire-extinguishing apparatus of claim 8, wherein the sound absorption material is configured by a laminate disposed downstream in a fire-extinguishing gas ejection direction of the nozzle hole.

10. The gas fire-extinguishing apparatus of claim 9, wherein the sound absorption material is made of the porous metal.

11. The gas fire-extinguishing apparatus of claim 7, wherein the fire-extinguishing gas is an inert gas selected from the group consisting of inert gas and halogen gas.

12. A gas fire-extinguishing apparatus, comprising:

an ejection head having a nozzle section which ejects high-pressure fire-extinguishing gas to a space;

a conduit pipe which is connected to the ejection head and guides high-pressure fire-extinguishing gas to the ejection head;

a fire-extinguishing gas supply source which supplies the high-pressure fire-extinguishing gas to the conduit pipe;

a silencer which is detachably mounted on an exterior peripheral surface of the ejection head and attenuates sound caused by ejection of the fire-extinguishing gas from the nozzle section, wherein the silencer comprises a mounting section detachably formed on the ejection head and integrally formed on a cylindrical peripheral wall of the silencer, an end wall disposed to be spaced downstream from the ejection head in an axial direction of the ejection head and extending to be perpendicular to the axial direction of the ejection head, a plurality of vent holes which penetrate the end wall in a thickness direction thereof, and a sound absorption material secured between the ejection head and the end wall, the silencer and the ejection head being threadably engaged with each other through threading on the mounting section of the silencer and threading on the exterior peripheral surface of the ejection head, and the mounting section having threads formed on an inner and an outer peripheral surface thereof.

* * * * *